US007537217B2

(12) United States Patent
Fukazawa et al.

(10) Patent No.: US 7,537,217 B2
(45) Date of Patent: May 26, 2009

(54) ARTICLE ACQUISITION GAME APPARATUS

(75) Inventors: Mitsuharu Fukazawa, Tokyo (JP); Takashi Nakajima, Tokyo (JP); Nobuto Kashiwagi, Tokyo (JP); Junichi Murakami, Tokyo (JP)

(73) Assignee: Sega Corporation, Tokyo (JP)

( * ) Notice: Subject to any disclaimer, the term of this patent is extended or adjusted under 35 U.S.C. 154(b) by 568 days.

(21) Appl. No.: 10/581,963

(22) PCT Filed: Dec. 9, 2004

(86) PCT No.: PCT/JP2004/018379

§ 371 (c)(1),
(2), (4) Date: Jun. 6, 2006

(87) PCT Pub. No.: WO2005/063348

PCT Pub. Date: Jul. 14, 2005

(65) Prior Publication Data

US 2007/0126185 A1 Jun. 7, 2007

(30) Foreign Application Priority Data

Dec. 25, 2003 (JP) ..... 2003-430566
Mar. 26, 2004 (JP) ..... 2004-092304

(51) Int. Cl.
*A63F 9/30* (2006.01)

(52) U.S. Cl. ..... 273/447; 273/448

(58) Field of Classification Search ..... 273/440, 273/447, 448

See application file for complete search history.

(56) References Cited

U.S. PATENT DOCUMENTS 5,368,310 A * 11/1994 Ogata et al. ..... 273/448
5,667,218 A * 9/1997 Kumabe et al. ..... 273/138.3
5,741,013 A * 4/1998 Hamano et al. ..... 273/447
2007/0126185 A1 * 6/2007 Fukuzawa et al. ..... 273/447

FOREIGN PATENT DOCUMENTS

JP 8-157109 A 6/1996
JP 08215422 A * 8/1996

(Continued)

OTHER PUBLICATIONS

Patent Abstract of Japan 10-179926 dated Jul. 7, 1998.

(Continued)

*Primary Examiner*—Raleigh W. Chiu
(74) *Attorney, Agent, or Firm*—Ladas and Parry LLP

(57) ABSTRACT

An article acquisition game apparatus includes a storage unit storing articles, and an article transferring unit enabling a player to hold the articles in the storage unit and transfer the articles to a predetermined transfer position when the player operates an operation input unit. The game apparatus comprises a distributing unit dividing the articles transferred to the transfer position into two or more groups, a first accumulation unit accumulating at least one group of the articles divided by the distributing unit, an article disbursement unit allowing the player to take out at least one group of the articles other than those accumulated by the first accumulation unit, an operating information generating unit generating operating information based on predetermined conditions, and an ejecting unit ejecting the articles accumulated by the first accumulation unit, to the article disbursement unit, based on the operating information.

19 Claims, 28 Drawing Sheets

FOREIGN PATENT DOCUMENTS

| | | | | |
|---|---|---|---|---|
| JP | 10015237 | A | * | 1/1998 |
| JP | 10-179926 | A | | 7/1998 |
| JP | 2599242 | | | 7/1999 |
| JP | 2001-29644 | A | | 2/2001 |
| JP | 2001-199111 | A | | 7/2001 |
| JP | 2003-144740 | A | | 5/2003 |
| JP | 2006129890 | A | * | 5/2006 |

OTHER PUBLICATIONS

Patent Abstract of Japan 2003-144740 dated May 20, 2003.
Gekkan Amusement Journal 2002 Nen 11 Getsugo; Oct. 30, 2002; vol. 2, No. 11, Whole No. 019, p. 120.
Patent Abstract of Japan 08-157109 Dated Jun. 18, 1996.
Patent Abstract of Japan 2001-199111 Dated Jun. 24, 2001.
Patent Abstract of Japan 2001-0296644 Dated Feb. 6, 2001.
JPO Computer English Translation of JP 2599242.

* cited by examiner

ARTICLE ACQUISITION GAME APPARATUS

TECHNICAL FIELD

The present invention relates to an article acquisition game apparatus which acquires articles, such as small premiums (petite prize) like confectionery or medals, by scooping up them with an arm or by catching them with a crane.

BACKGROUND ART

Generally, in the article acquisition game apparatus of this kind, the articles placed on the turntable are scooped up or caught with the arm or the like and the articles are dropped into the premium outlet so that the articles can be acquired from the premium outlet.

In order to give the chance of article acquisition to anyone equally and enable anyone to easily enjoy playing the game, a new game apparatus has been proposed by improvement of the above-mentioned game apparatus. In the new game apparatus, buckets in which the articles are accommodated beforehand are arranged above the main board respectively for the players, and the inclination of each bucket is changed according to a selected number of a roulette so that the articles are dropped from the bucket. For example, see Japanese Laid-Open Patent Application No. 2003-144740.

Moreover, in order to allow the article to be scooped up certainly, a new game apparatus has been proposed. In the new game apparatus, the central part of the turntable is provided with a raised part in a generally conical shape, and the bucket is moved from the center of the turntable to the peripheral part thereof so that the article is scooped up with the bucket. For example, see Japanese Registered Utility Model No. 2599242.

The game apparatus of Japanese Laid-Open Patent Application No. 2003-144740 mentioned above is useful in that the chance of article acquisition is given to any of persons who play the game for the first time. However, since the buckets are arranged respectively for all the players, each player chiefly concentrates on acquiring his own article with the bucket, and there is no competition of article acquisition arising between the player and other players. In the case of the above-mentioned game apparatus, it is difficult to create a deep interest in playing the game.

Moreover, when the articles in the bucket become empty, it is necessary for the player to ask the salesperson to replenish the bucket with new articles. During the replenishment work the player cannot play the game, and the burden on the salesperson's replenishment work is somewhat heavy. In addition, the number of articles and the kind of articles which can be obtained from the bucket are what have been replenished by the salesperson, and the player may have a forced feeling. In the case of the above-mentioned game apparatus, it is difficult to create a deep interest in playing the game.

Embodiments of the present invention solve or reduce one or more of the above-mentioned problems. Embodiments of the present invention provide an article acquisition game apparatus which allows competition of article acquisition between the plurality of players, makes the replenishment of the articles by the salesperson unnecessary, and offers high game features in which the articles obtained as the premiums increase gradually according to the progress of the game by the plurality of players.

DISCLOSURE OF THE INVENTION

According to one aspect of the invention, there is provided an article acquisition game apparatus including a storage unit storing a plurality of articles, and an article transferring unit enabling a player to hold the articles in the storage unit and transfer the articles to a predetermined transfer position when the player operates an operation input unit, the article acquisition game apparatus comprising: a distributing unit dividing the articles transferred to the transfer position into two or more groups; a first accumulating unit accumulating at least one group of the articles divided by the distributing unit; an article disbursement unit allowing the player to take out at least one group of the articles other than the articles accumulated by the first accumulating unit; an operating information generating unit generating operating information based on predetermined conditions; and an ejecting unit ejecting the articles accumulated by the first accumulating unit, to the article disbursement unit, based on the operating information.

According to another aspect of the invention, there is provided an article acquisition game apparatus including a storage unit storing a plurality of articles, and an article transferring unit enabling a player to hold the articles in the storage unit and transfer the articles to a predetermined transfer position when the player operates an operation input unit, the article acquisition game apparatus comprising: a distributing unit dividing the articles transferred to the transfer position into two or more groups; a first accumulating unit accumulating at least one group of the articles divided by the distributing unit; a second accumulating unit accumulating at least one group of the articles other than the articles accumulated by the first accumulating unit; an article disbursement unit allowing the player to take out part of the articles accumulated by the second accumulating unit; a transportation unit transporting the articles accumulated by the second accumulating unit, to the article disbursement unit; an operating information generation unit generating operating information based on predetermined conditions; and an ejecting unit ejecting the articles accumulated by the first accumulating unit, to the article disbursement unit, based on the operating information.

According to another aspect of the invention, there is provided an article acquisition game apparatus including a storage unit storing a plurality of articles, and an article transferring unit enabling a player to hold the articles in the storage unit and transfer the articles to a predetermined transfer position when the player operates an operation input unit, the article acquisition game apparatus comprising: a distributing unit dividing the articles transferred to the transfer position into two or more groups; a first accumulating unit accumulating at least one group of the articles divided by the distributing unit; a second accumulating unit accumulating at least one group of the articles other than the articles accumulated by the first accumulating unit; an article disbursement unit allowing the player to take out part of the articles accumulated by the second accumulating unit; a transportation unit transporting the articles accumulated by the second accumulating unit, to the article disbursement unit; an operating information generation unit generating operating information based on predetermined conditions; and an ejecting unit ejecting the articles accumulated by the first accumulating unit, to the second accumulating unit, based on the operating information.

According to another aspect of the invention, there is provided an article acquisition game apparatus including a storage unit storing a plurality of articles, and an article transferring unit enabling each of a plurality of players to hold the articles in the storage unit and transfer the articles to a predetermined transfer position when each player operates an operation input unit provided for each player, the article acquisition game apparatus comprising: a distributing unit dividing the articles transferred to the transfer position into two or more groups; a first accumulating unit provided in common for the plurality of players and accumulating at least one group of the articles divided by the distributing unit; a second accumulating unit accumulating at least one group of the articles other than the articles accumulated by the first accumulating unit; an article disbursement unit provided for each player and allowing the player concerned to take out part of the articles accumulated by the second accumulating unit; a transportation unit transporting the articles accumulated by the second accumulating unit, to the article disbursement unit; an operating information generation unit generating operating information based on predetermined conditions; and an ejecting unit ejecting the articles accumulated by the first accumulating unit, to the article disbursement unit, based on the operating information.

According to another aspect of the invention, there is provided an article acquisition game apparatus including a storage unit storing a plurality of articles, and an article transferring unit enabling each of a plurality of players to hold the articles in the storage unit and transfer the articles to a predetermined transfer position when each player operates an operation input unit provided for each player, the article acquisition game apparatus comprising: a distributing unit dividing the articles transferred to the transfer position into two or more groups; a first accumulating unit provided in common for the plurality of players and accumulating at least one group of the articles divided by the distributing unit; a second accumulating unit accumulating at least one group of the articles other than the articles accumulated by the first accumulating unit; an article disbursement unit provided for each player and allowing the player concerned to take out part of the articles accumulated by the second accumulating unit; a transportation unit transporting the articles accumulated by the second accumulating unit, to the article disbursement unit; an operating information generation unit generating operating information based on predetermined conditions; and an ejecting unit ejecting the articles accumulated by the first accumulating unit, to the second accumulating unit, based on the operating information.

The above-mentioned game apparatus may be configured so that the distributing unit comprises a distribution board provided in a drop route of the articles, the distribution board including a flat portion and a downwardly curved lug portion on one side of the flat portion.

The above-mentioned game apparatus may be configured so that the operating information generation unit uses, as a trigger to generate the operating information, a detection signal which is outputted by a sensor switch when the sensor switch contacts the articles.

The above-mentioned game apparatus may be configured so that the article acquisition game apparatus further comprises a lamp ring in which lamps are arranged in a ring formation, the lamps being turned on sequentially so that lighting of the lamps occurs around a circumference of the lamp ring, wherein a jackpot formation which causes the ejecting unit to work is detected when a lighting position of the lamp ring is in a predetermined position at the time of generating of the operating information by the operating information generating unit.

The above-mentioned game apparatus may be configured so that, when a coin is not inserted by the player after operation of the ejecting unit, the article transferring unit is automatically operated so that the first accumulating unit is replenished with additional articles.

The above-mentioned game apparatus may be configured so that the transportation unit comprises: a plank-like pusher; a roller having a center movable along a circular locus; and a guide groove formed in a back surface of the pusher and brought in contact with the roller, the guide groove extending in a direction perpendicular to a direction of a sliding motion of the pusher, wherein a radius of the locus of the roller is variable.

The above-mentioned game apparatus may be configured so that the transportation unit comprises: a plurality of plank-like pushers; a groove cam in which a guide groove is formed; a rocking crank provided for each of the plurality of plank-like pushers and brought in contact at a first end with the guide groove formed in the groove cam; and a guide groove formed in a back surface of each of the plurality of plank-like pushers and brought in contact with a roller at a second end of the rocking crank, the guide groove extending in a direction perpendicular to a direction of a sliding motion of a corresponding one of the plurality of plank-like pushers, wherein a radius of rotation of the roller is variable.

The above-mentioned game apparatus may be configured so that the first accumulating unit comprises a jackpot tray, and the ejecting unit is adapted for ejecting the articles from the jackpot tray.

The above-mentioned game apparatus may be configured so that the first accumulating unit comprises a jackpot tray which is provided with a slope having a loose inclination in a direction in which the articles are taken out.

The above-mentioned game apparatus may be configured so that the first accumulating unit comprises a jackpot tray, and the ejecting unit is adapted for rotating the jackpot tray to a position confronting the player, and for inclining the jackpot tray to eject the articles to the article disbursement unit.

The above-mentioned game apparatus may be configured so that the article acquisition game apparatus further comprises a detecting unit detecting whether the jackpot tray is in a predetermined position, when the jackpot tray is housed.

The above-mentioned game apparatus may be configured so that the first accumulating unit comprises a jackpot tray, and the ejecting unit is adapted such that rotation of the jackpot tray to a position confronting the player, and inclination of the jackpot tray to eject the articles to the article disbursement unit are performed by either a forward rotation operation or a reverse rotation operation of a motor driving the jackpot tray.

The above-mentioned game apparatus may be configured so that one of a forward rotation operation and a reverse rotation operation of the motor driving the jackpot tray is selected by using a one-way clutch which is provided on a drive shaft of the motor.

The above-mentioned game apparatus may be configured so that one of a forward rotation operation and a reverse rotation operation of the motor driving the jackpot tray is selected by using a latch mechanism which is provided on a drive shaft of the motor.

The above-mentioned game apparatus may be configured so that a normal operation related to article acquisition is suspended during the ejecting of the articles to the article disbursement unit by the ejecting unit.

According to the article acquisition game apparatus of an embodiment of the invention, the first accumulation unit common to the players is provided, and the article acquisition game apparatus is a progressive system in which the articles are gradually accumulated according to the progress of the game. The chance of discharging all the articles of the first accumulation unit is given to the player of concern by forming a jackpot (great success) according to situations of article acquisition, so that the player of concern can acquire a large number of articles. It is possible to provide an article acquisition game apparatus which creates competition of article acquisition between the player of concern and other players, makes the replenishment of the articles by the salesperson unnecessary, and offers high game features in which the articles obtained as the premiums increase gradually according to the progress of the game by the player of concern and other players.

BEST MODE FOR CARRYING OUT THE INVENTION

A description will now be given of embodiments of the invention with reference to the accompanying drawings.

In the following embodiments, it is supposed that the articles are small premiums (petite prize) such as confectionery. However, it is a matter of course that the articles may be arbitrary ones other than the small premiums including medals.

Figure 1:
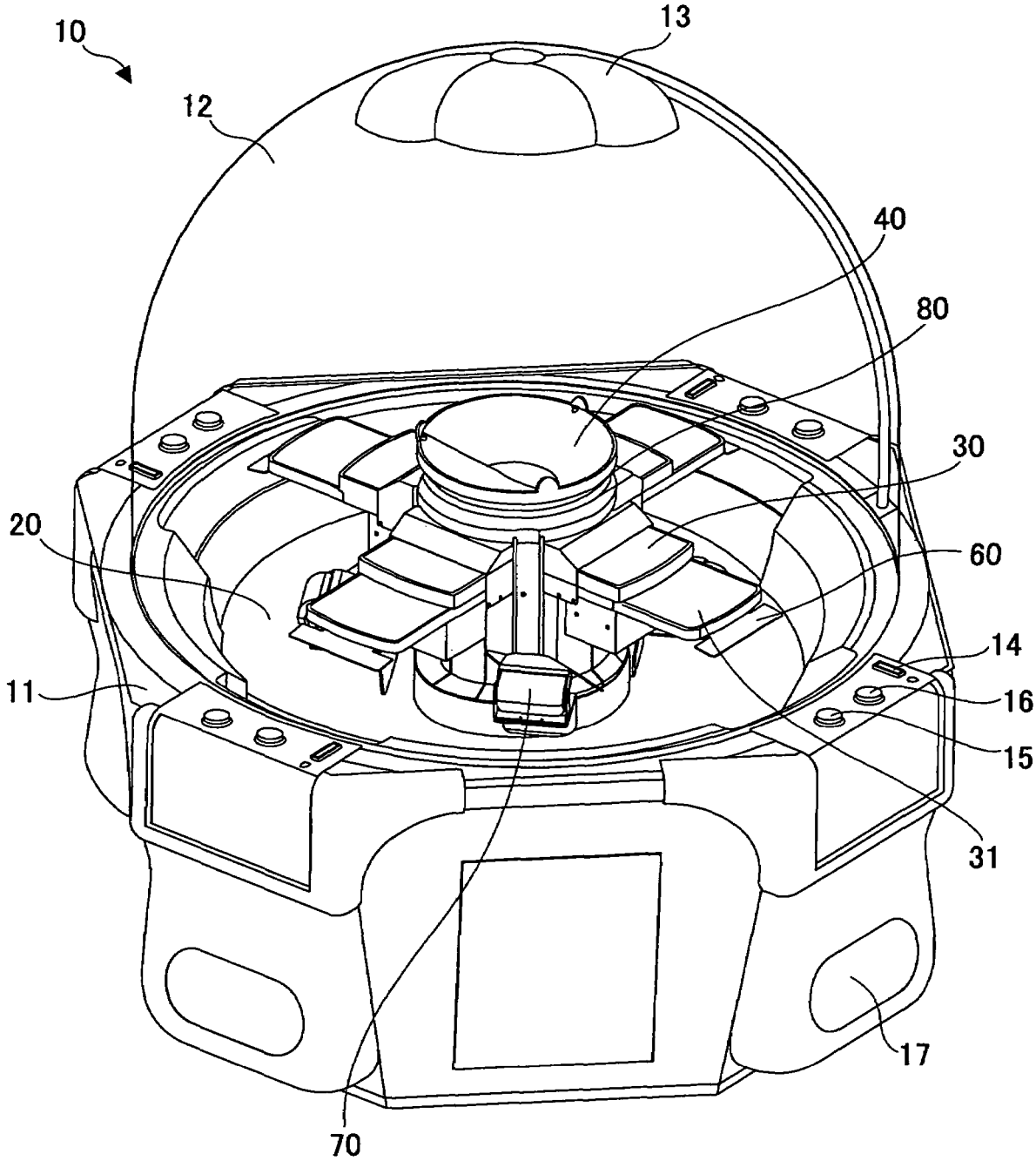
FIG. 1 is a perspective view of an article acquisition game apparatus in an embodiment of this invention.
Figure 2:
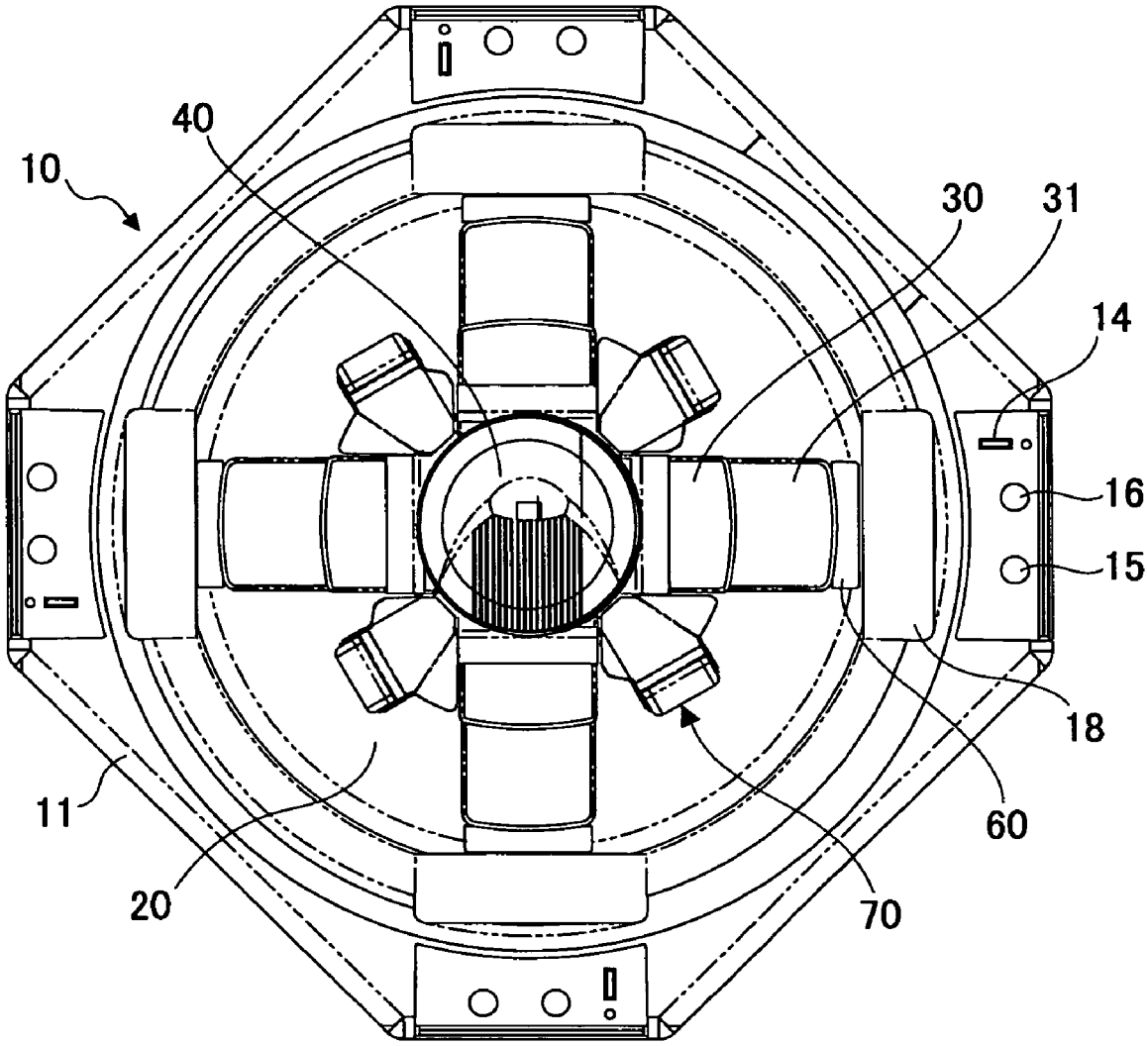
FIG. 2 is a top view of the article acquisition game apparatus of FIG. 1 when viewed from the upper part.
Figure 3:
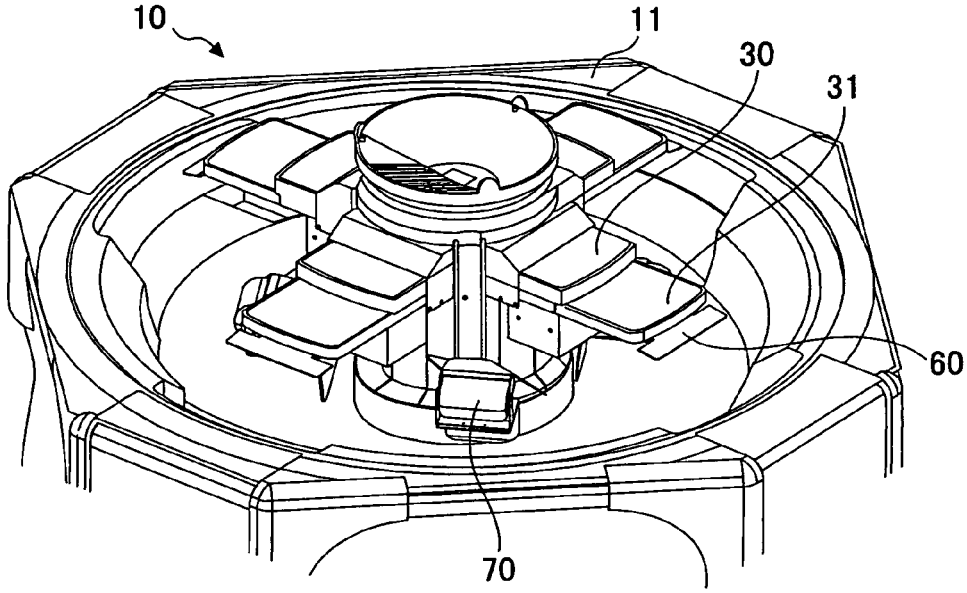
FIG. 3 is a diagram showing a mechanism part of the center of the article acquisition game apparatus of FIG. 1.

FIG. 1 shows the composition of an article acquisition game apparatus 10 in an embodiment of the invention. FIG. 2 shows the article acquisition game apparatus 10 of FIG. 1 when viewed from the upper part. FIG. 3 shows a mechanism part of the center of the article acquisition game apparatus 10 of FIG. 1.

In FIGS. 1 to 3, the outside framework of the article acquisition game apparatus 10 is formed by a box-shaped base 11 and a transparent dome 12 which covers the upper surface of the base 11. Lighting 13 which illuminates the inside of the article acquisition game apparatus 10 is provided at the upper part of the inside of the transparent dome 12.

As shown, the article acquisition game apparatus 10 is of the type that can be played by up to four players. There are provided on the base 11, for every player, a coin slot 14 through which the coin is inserted at the time of start of the game, a scoop-up button 15 which is pushed when scooping up the articles, and a drop button 16 which is pushed when dropping the scooped-up articles. Moreover, there is provided in the lower part of the base 11, for every player, a premium outlet 17, and this premium outlet 17 forms the article disbursement unit allowing the player to take out the acquired articles.

The number of players can be set up arbitrarily for the article acquisition game apparatus 10, and the article acquisition game apparatus 10 may be constituted for only one player.

The mechanism part of the center of the article acquisition game apparatus 10 includes a turntable 20 which is arranged in the recessed portion that is lower than the upper surface of the base 11, and this turntable 20 forms the storage unit storing the plurality of articles. A pusher 30 and a fixed stand 31 are arranged for every player on the turntable 20 in a radial manner. The pusher 30 and the fixed stand 31 form the transportation unit and the second accumulating unit respectively. A jackpot tray 40 and a lamp ring 80 which are common to the respective players are arranged above the pushers 30 and the fixed stands 31. The jackpot tray 40 forms the first accumulating unit.

In the above embodiment, the turntable 20 of rotary type is provided. Alternatively, the turntable 20 may be configured into a fixed type or a right/left parallel translation type. The pusher 30 may be configured into another mechanism, or may be replaced by a slope, or the pusher 40 may be omitted.

Moreover, the position and configuration of the lamp ring 80 and the jackpot tray 40 are not limited to the above embodiment. The first accumulating unit is not limited to the tray type in the above embodiment, and it may be configured into an arbitrary shape, such as the shape of a bowl or a cylinder, as long as it can accumulate the articles as the first accumulating unit. The lamp ring 80 may be replaced with a roulette or slot-machine type.

Moreover, in the article acquisition game apparatus 10 of FIG. 1, an arm 70 is arranged for every player on the left-hand side of the pusher 30 and the fixed stand 31 of each player. The arm 70 forms the article transferring unit which scoops up the premiums on the turntable 20, moves them to a predetermined height, and drops the premiums. The arm 70 may be adapted for holding the premiums, instead of scooping up them. The arm 70 may be adapted for placing the premiums on a predetermined location, instead of dropping them. The arm 70 may be replaced with another mechanism.

Moreover, in the article acquisition game apparatus 10 of FIG. 1, a sensor switch 60 which detects whether the premiums falls toward the premium outlet 17 is arranged at the leading edge of the fixed stand 31, and this sensor switch 60 forms the sensor which detects the state of the premiums and gives the trigger to generate the operating information to the controlling circuit unit. The controlling circuit unit forms the operating information generating unit.

In the above embodiment, the mechanical switch is used for the sensor switch 60. Alternatively, the sensor switch 60 may be configured into an optical sensor. The state of the premiums to be detected by the sensor may be different from falling of the premiums.

In the article acquisition game apparatus 10 of FIG. 1, a shutter 18 is provided in the inside opening of the premium outlet 17. When playing of the game is not started, the shutter 18 closes the inside opening of the premium outlet 17.

Figure 4:
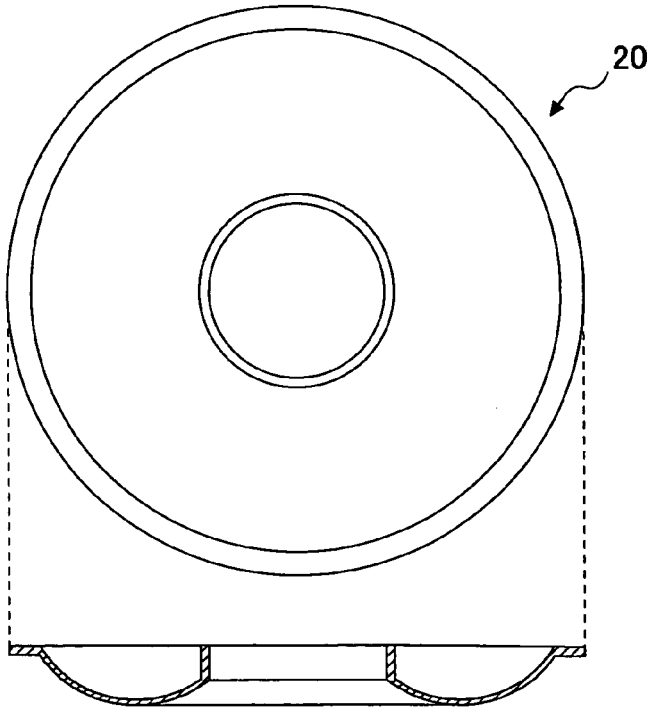
FIG. 4 is a diagram showing an example of the turntable.

FIG. 4 shows an example of the turntable 20. The upper half of FIG. 4 is a plan view of the turntable 20 and the lower half of FIG. 4 is a cross-sectional view of the central part of the turntable 20.

As shown in FIG. 4, the turntable 20 has a cross section in a generally round shape. The peripheral portion of the turntable 20 is formed by a curved surface which is convex in the downward direction. The central portion of the turntable 20 is formed with the central hole in which the mechanism part is accommodated, and the central hole is formed with the vertically raised wall between the central portion and the peripheral portion of the turntable 20.

Figure 5:
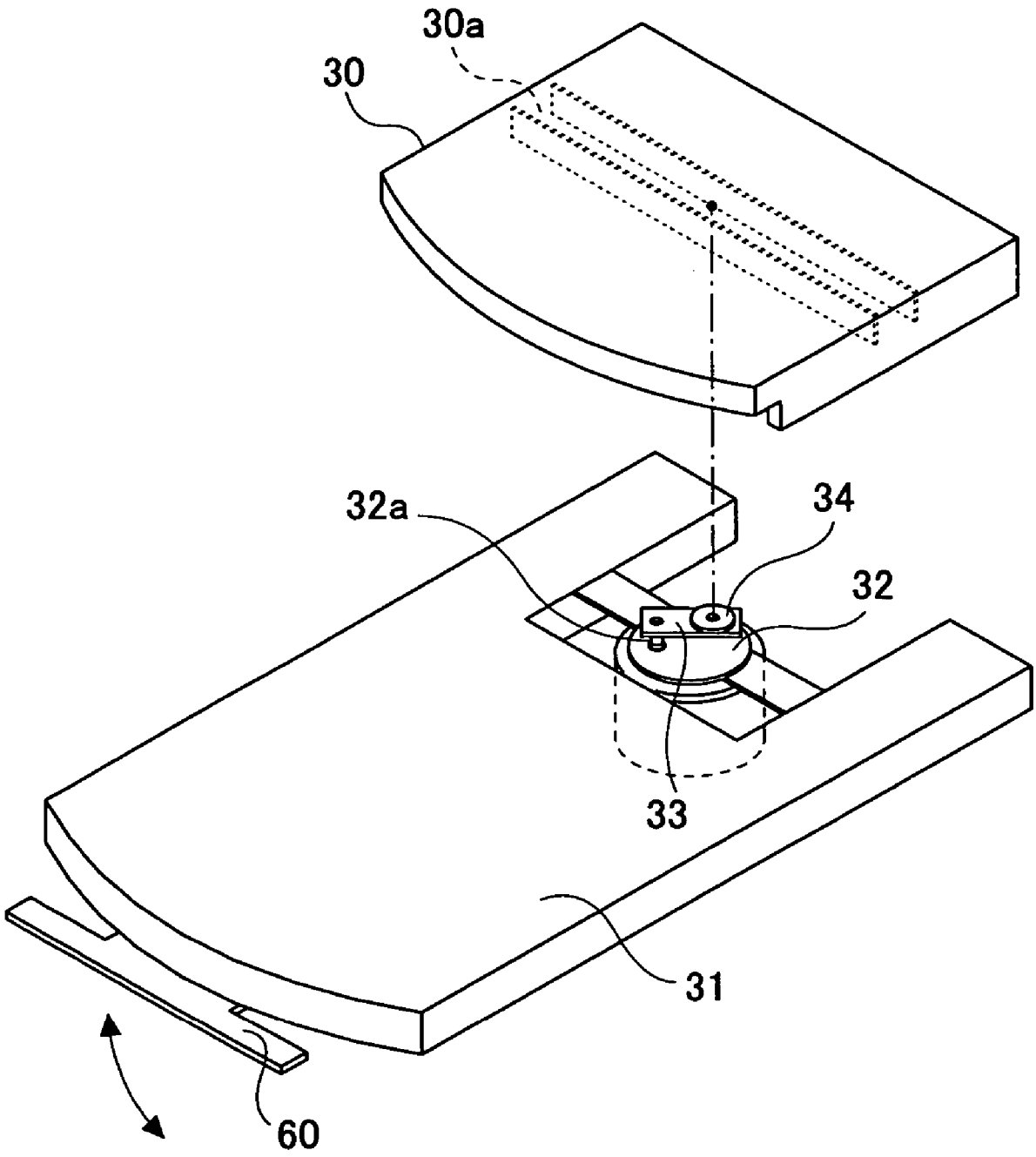
FIG. 5 is a diagram showing an example of the pusher drive mechanism.

FIG. 5 shows an example of the drive mechanism of the pusher 30.

As shown in FIG. 5, the motor 32 is fixed to the rear of the plate-like fixed stand 31, the crank 33 is attached to the drive shaft 32*a* of the motor 32, and the roller 34 is attached to the crank 33 at a predetermined radius position from the drive shaft 32*a*.

The guide groove 30*a* is formed in the back surface of the plank-like pusher 30 such that the guide groove 30*a* extends in the direction perpendicular to the sliding direction of the pusher 30. When the pusher 30 is fitted to the fixed stand 31, the roller 34 is brought in contact with the inside wall of the guide groove 30*a*. The crank 33 is rotated by the rotation of the motor 32, and the reciprocating sliding motion of the pusher 30 on the fixed stand 31 is caused according to the movement of the roller 34 in a circular locus.

Figure 6:
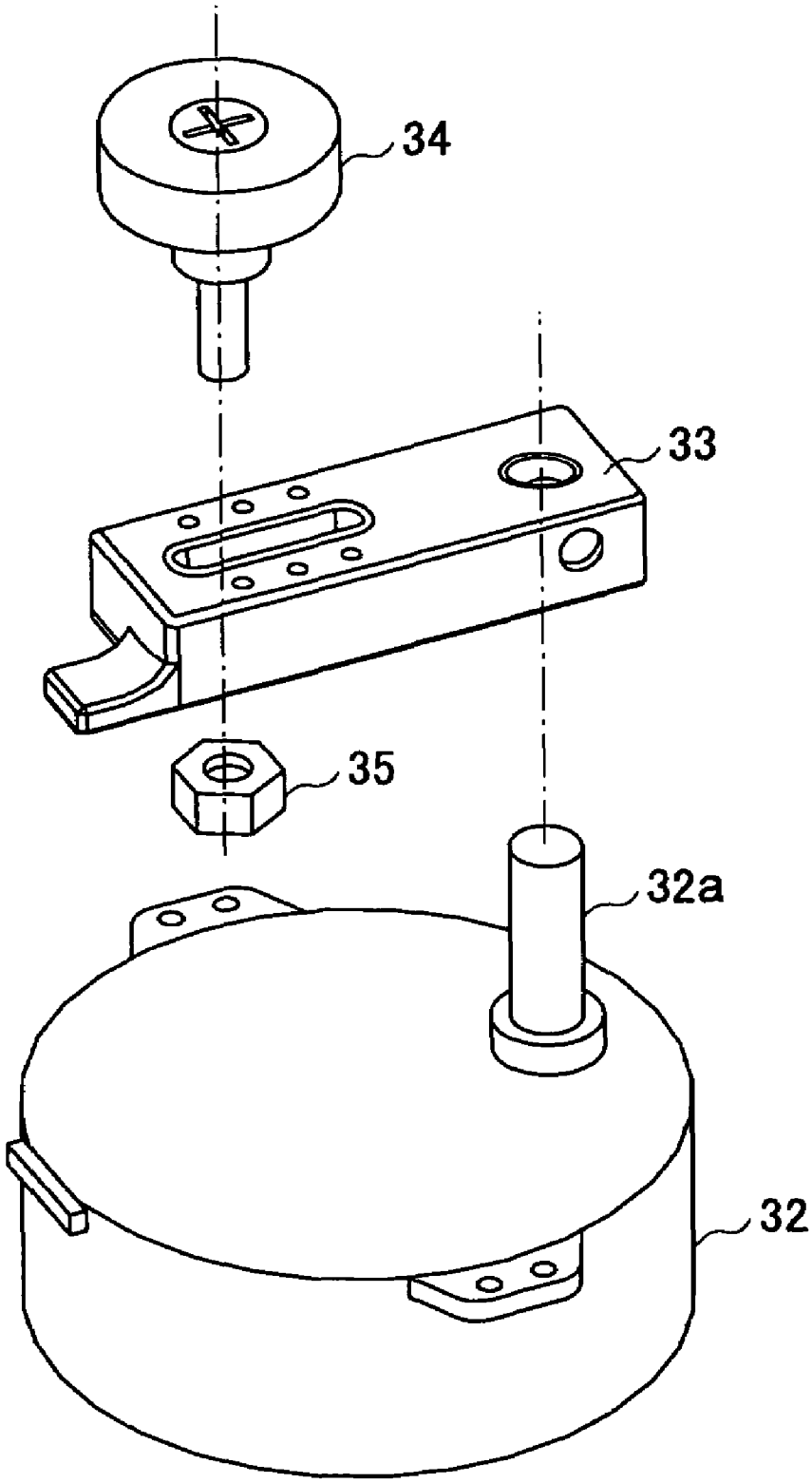
FIG. 6 is an exploded diagram of the neighboring part of the motor of FIG. 5.

FIG. 6 is an exploded diagram of the neighboring part of the motor 32 of FIG. 5. As shown in FIG. 6, by changing the position where the roller 34 is attached to the crank 33 by the nut 35, the radius of the locus in which the roller 34 is moved can be changed freely. Thereby, it is possible to easily adjust the sliding width (stroke) of the pusher 30.

Therefore, various kinds of premiums can be used in the article acquisition game apparatus 10 by setting up the sliding width of the pusher 30. For example, when the premiums having a large size are used, the sliding width of the pusher 30 is set up to be relatively large. When the premiums having a small size are used, the sliding width of the pusher 30 is set up to be relatively small.

Moreover, even when the premiums of the same size are used, the difficulty of article acquisition can be adjusted by changing the sliding width of the pusher 30. Namely, the difficulty of article acquisition can be increased if the sliding width of the pusher 30 is set up to be relatively large. On the other hand, the difficulty of article acquisition can be lowered if the sliding width of the pusher 30 is set up to be relatively small.

Figure 7:
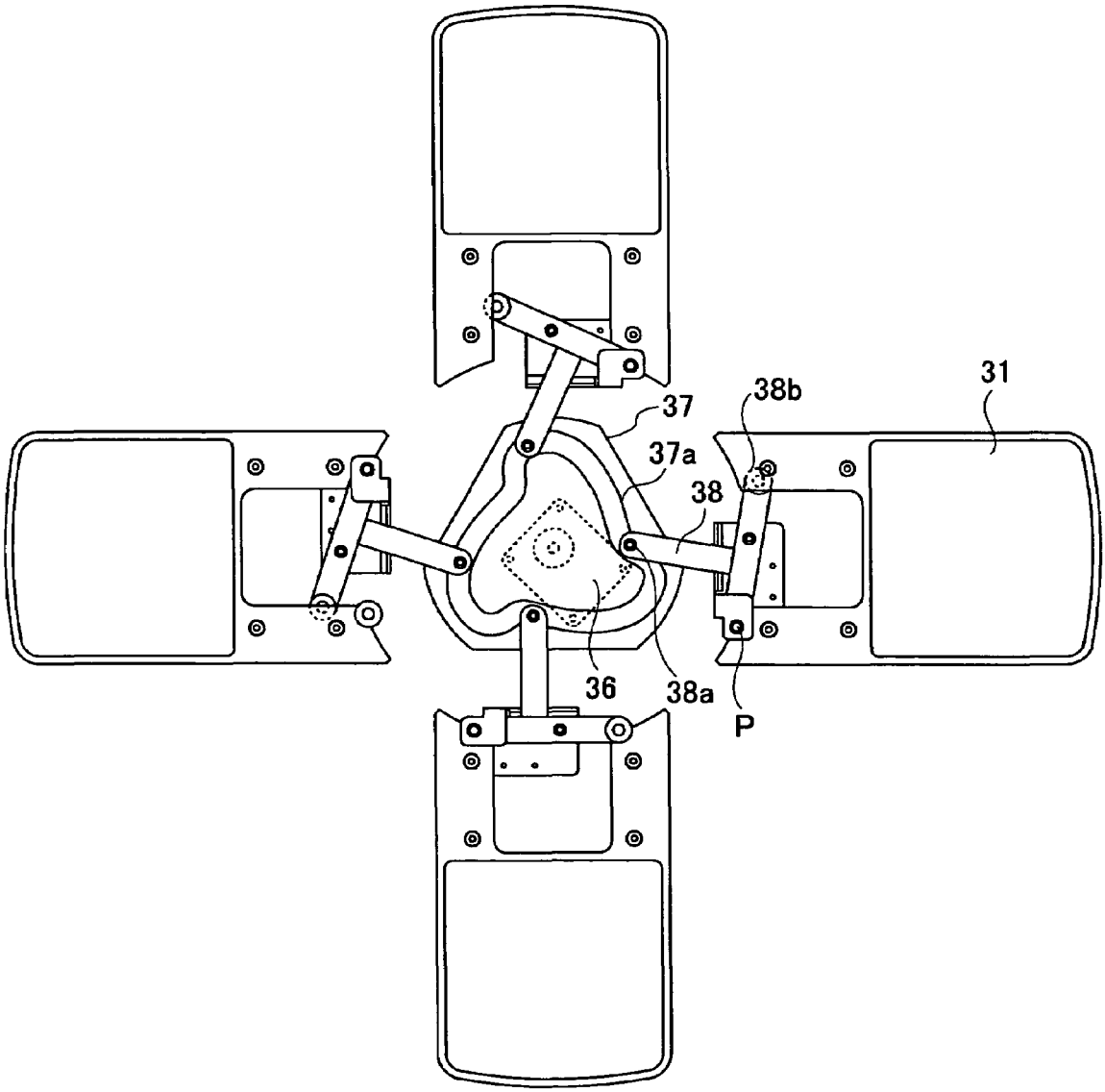
FIG. 7 is a diagram showing another example of the pusher drive mechanism.
Figure 8:
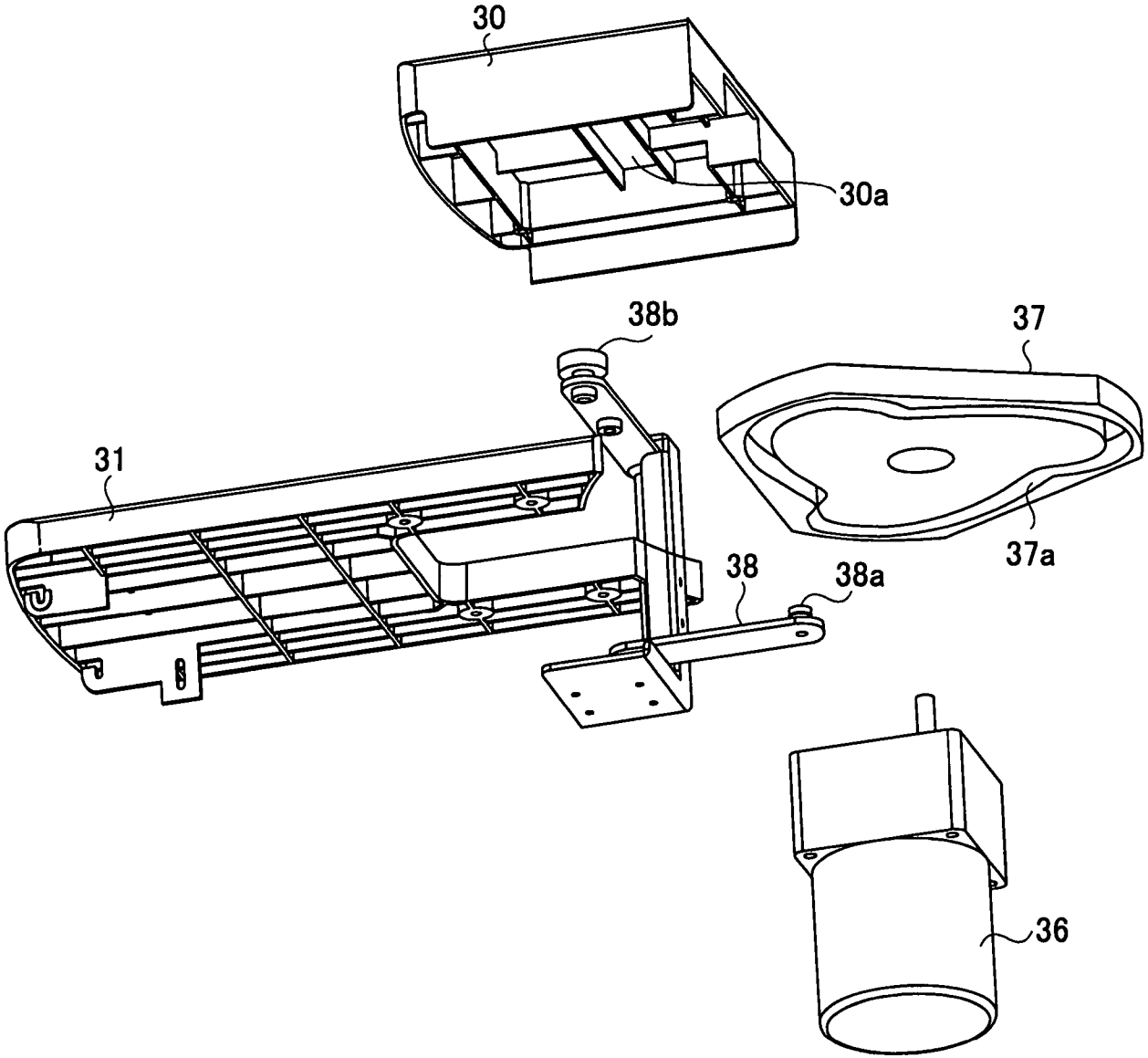
FIG. 8 is an exploded diagram of the neighboring part of the motor of FIG. 7.

FIG. 7 shows another example of the drive mechanism of the pusher 30. FIG. 8 is an exploded diagram of the neighboring part of the motor of FIG. 7.

In the example of the drive mechanism shown in FIG. 5 and FIG. 6, it is necessary that the motor 32 is provided for every pusher 30. In this respect, in the example of the drive mechanism shown in FIG. 7 and FIG. 8, the use of a single motor 36 enables the reciprocating sliding motion of the plurality of pushers 30.

As shown in FIG. 7 and FIG. 8, the guide groove 37*a* is formed in the back surface of the groove cam 37 attached to the motor 36, and the distance of the guide groove 37*a* from the center of the groove cam 37 changes according to the sliding motion of the pusher 30. The roller 38*a* is provided at one end of the rocking crank 38 and brought in contact with the inside wall of the guide groove 37*a*. The rocking crank 38 is supported on the fixed stand 31 pivotally at the rotating shaft P. When the roller 38*a* at one end of the rocking crank 38 is moved along the guide groove 37*a*, the roller 38*b* at the other end of the rocking crank 38 is rocked.

The guide groove 30*a* is formed in the back surface of the plank-like pusher 30 such that the guide groove 30*a* extends in the direction perpendicular to the sliding direction of the pusher 30. When the pusher 30 is fitted to the fixed stand 31, the roller 38*b* of the rocking crank 38 is brought in contact with the inside wall of the guide groove 30*a*. The groove cam 37 is rotated by the rotation of the motor 36, and the reciprocating sliding motion of the pusher 30 on the fixed stand 31 is caused.

The sliding width of the pusher 30 can be easily adjusted by changing the fixing position of the roller 38*b* on the rocking crank 38, i.e., the rocking radius from the rotating shaft P.

Figure 9:
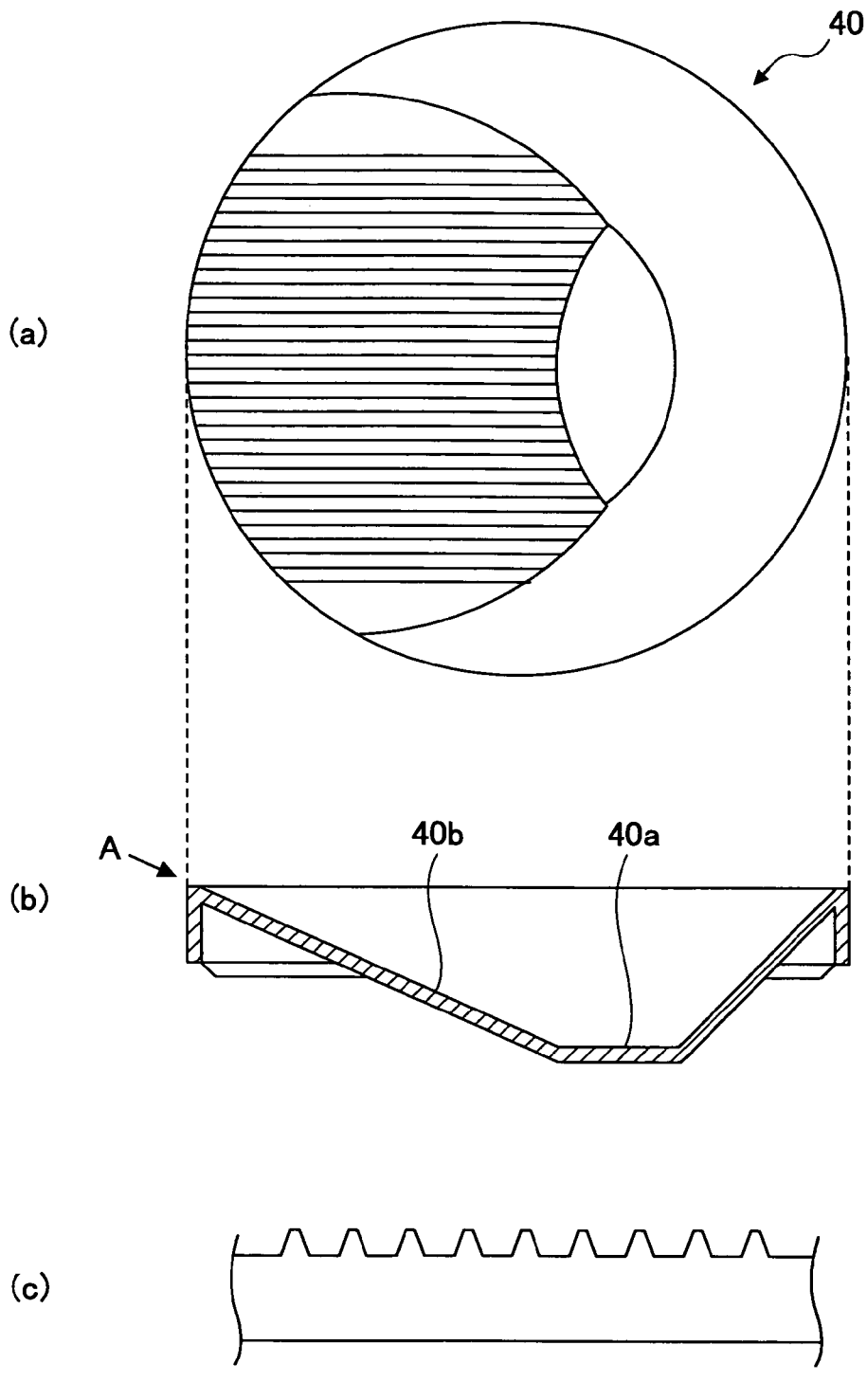
FIG. 9 is a diagram showing an example of the jackpot tray.

FIG. 9 shows an example of the jackpot tray 40. In FIG. 9, (a) is a plan view of the jackpot tray 40, (b) is a cross-sectional view of the jackpot tray 40 taken along the central part thereof, and (c) is an enlarged view of the end face of the jackpot tray 40 when viewed from the direction of the arrow A in FIG. 9 (*b*). In FIGS. 9 (*a*) and (*b*), the left-hand side is the direction to which the premiums are ejected.

As shown in FIG. 9, the jackpot tray 40 has the shape of a circular plate and is arranged in a dish-like configuration. The bottom 40*a* is arranged at an off-center location of the jackpot tray 40, and the slope 40*b* having a loose inclination is formed such that the slope 40*b* extends from the bottom 40*a* in the direction to which the premiums are ejected.

When the jackpot tray 40 is inclined from the level position to the direction to which the premiums are ejected, the inclination of the slope 40*b* becomes steep so that all the premiums can be ejected completely.

Figure 10:
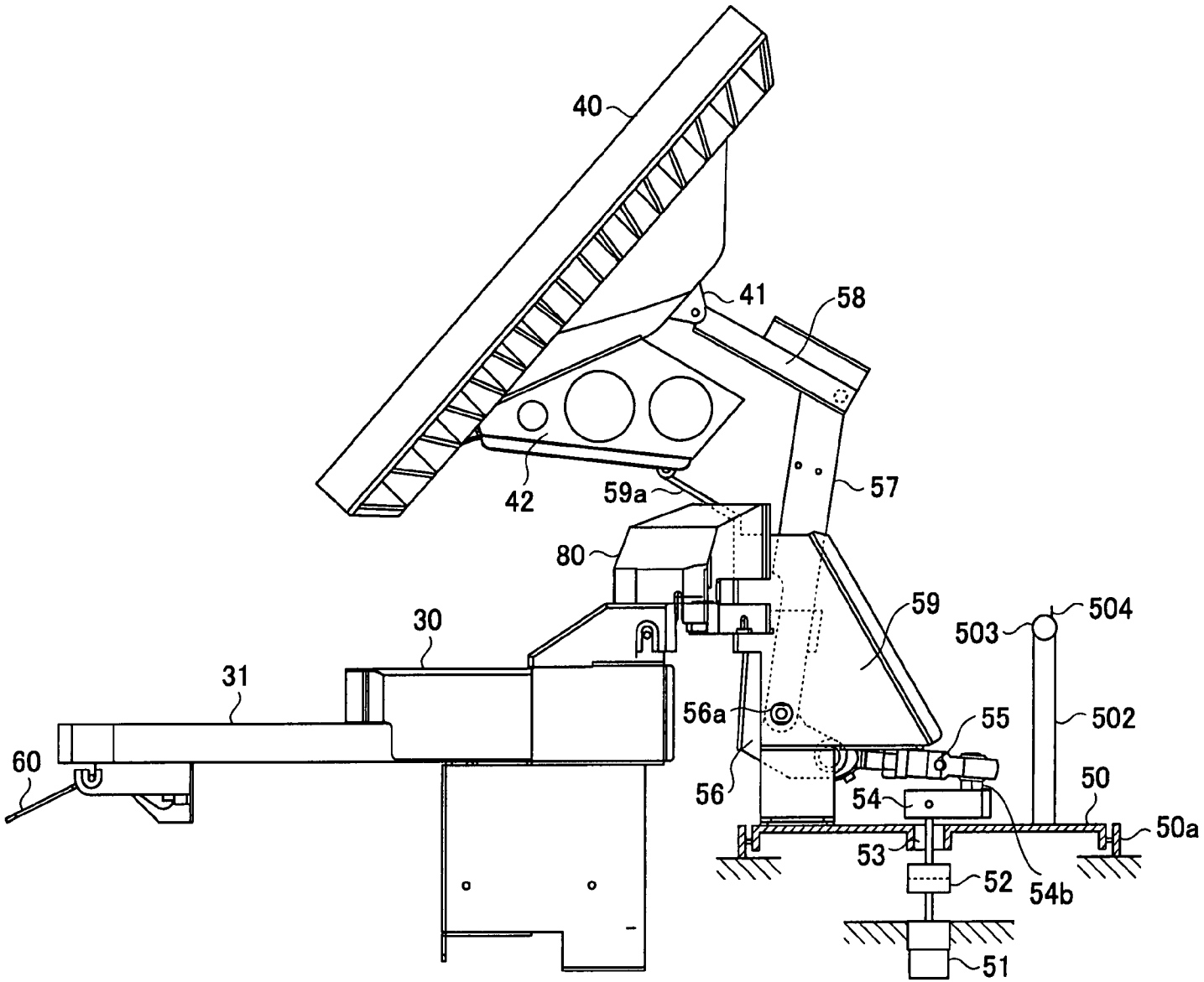
FIG. 10 is a diagram showing an example of the drive mechanism of the jackpot tray.

FIG. 10 shows an example of the drive mechanism of the jackpot tray 40. In the example of FIG. 10, the state in which the jackpot tray 40 is inclined by the drive mechanism is illustrated.

As shown in FIG. 10, the drive mechanism, except the neighboring parts of the motor 51, is fixed on the turntable 50 in a generally circular shape. The turntable 50 is rotatable with the rollers 50*a*. When the turntable 50 is rotated, the jackpot tray 40 is rotated together with the drive mechanism. The rotation of the jackpot tray 40 is performed while the jackpot tray 40 is set in the level position.

The central part of the turntable 50 is secured through the one-way clutch 53 to the drive shaft of the motor 51. When the motor 51 is rotated in one direction (forward rotation), the engagement of the one-way clutch 53 occurs so that the turntable 50 is rotated by the motor 51. When the motor 51 is rotated in the opposite direction (reverse rotation), the one-way clutch 53 is disengaged so that the turntable 50 is not rotated. For the purpose of preventing occurrence of excessive torque, the torque tender 52 is provided on the rotating shaft of the motor 51.

The crank 54 is provided on the upper side of the turntable 50 and attached to the drive shaft of the motor 51. And the joint 55, the connecting piece 56, the rod 57, the rod 58, and the mounting piece 41 are rotatably connected to the shaft 54*b* on the outer periphery side of the crank 54 one by one. The elements 55-58 constitute the linkage mechanism. The mounting piece 41 is fixed to the bottom of the jackpot tray 40.

The connecting shaft 56*a* between the connecting piece 56 and the rod 57 is supported pivotally on the supporting base 59 fixed onto the turntable 50. The roller is provided at the end of the mounting piece 59*a* extending from the supporting base 59, and this roller is brought in rolling contact with the slope of the mounting piece 42 fixed to the bottom of the jackpot tray 40.

Even when an excessively large premium is on the pusher 30 and the end of the jackpot tray 40 contacts the premium, the slope of the mounting piece 42 and the roller at the end of the mounting piece 59*a* can be separated from each other, thereby preventing breakage of the jackpot tray 40.

As previously described, when the motor 51 is rotated in the forward direction, the turntable 50 is rotated. On the other hand, when the motor 51 is rotated in the reverse direction, the crank 54 is rotated and the joint 55 is moved in the right/left direction in the drawing of FIG. 10.

In the example of FIG. 10, the state in which the joint 55 is moved to the limit of the right-hand side is illustrated. In this state, the jackpot tray 40 is inclined.

When the joint 55 is moved to the limit of the left-hand side, the linkage mechanism, including the joint 55, the connecting piece 56, the rod 57 and the rod 58, is set in the folded-up state, so that the jackpot tray 40 is housed in the level position.

Namely, during the normal state of the game, the jackpot tray 40 is rotated in the horizontal state by the forward rotation of the motor 51. When the jackpot formation occurs, the rotation of the jackpot tray 40 is stopped at the position confronting the player concerned, and the jackpot tray 40 is inclined by the reverse rotation of the motor 51 so that the premiums stored in the jackpot tray 40 are ejected to the fixed stand 31.

It is not necessary which the stop position of the jackpot tray 40 is the position exactly located in front of the player. Namely, the stop position of the jackpot tray 40 may be shifted from the position in front of the player to right and left somewhat, depending on the design of the apparatus. In other words, the rotation of the jackpot tray 40 may be stopped around the position in front of the player (the same discussion is also applicable in the following explanation).

The motor 36 in the drive mechanism for driving the reciprocating sliding motion of the pusher 30, showed in FIG. 7 and FIG. 8, and the motor 51 shown in FIG. 10 may be constituted by using a single motor. In such a case, the groove cam 37 is attached to the rotation shaft between the torque tender 52 and the one-way clutch 53.

In the example of FIG. 10, a supporting base 502 is provided on the turntable 50. A roller 503 and a plunger 504 are provided on the top of the supporting base 502 so that the bottom of the jackpot tray 40 smoothly comes in contact with the supporting base 502. The plunger 504 is depressed when the bottom of the jackpot tray 40 touches it. The elements 502-504 constitute the detecting unit detecting whether the jackpot tray 40 is in the horizontal position when the jackpot tray 40 is housed.

There is a possibility that the mechanical part be damaged when playing the game is continued with the jackpot tray 40 being set in the slanting state. To obviate the problem, the use of the detecting unit makes it possible to detect whether the jackpot tray 40 is in the horizontal position correctly. Moreover, the plunger 504 with which the bottom of the jackpot tray 40 comes in contact is provided in a relatively high position among the elements of the mechanical part. Thus, it is possible to prevent the detecting unit detecting the horizontal position of the jackpot tray 40 from malfunctioning or being damaged due to the falling of the premiums.

Moreover, the plunger 504 is provided on the turntable 50, and the switch (which will be described later) which is activated by the plunger 504 is provided on the side of the fixed stand. Thus, there is the advantage that it is not necessary to use the expensive slip ring for making electric connection with the rotating part.

Figure 11:
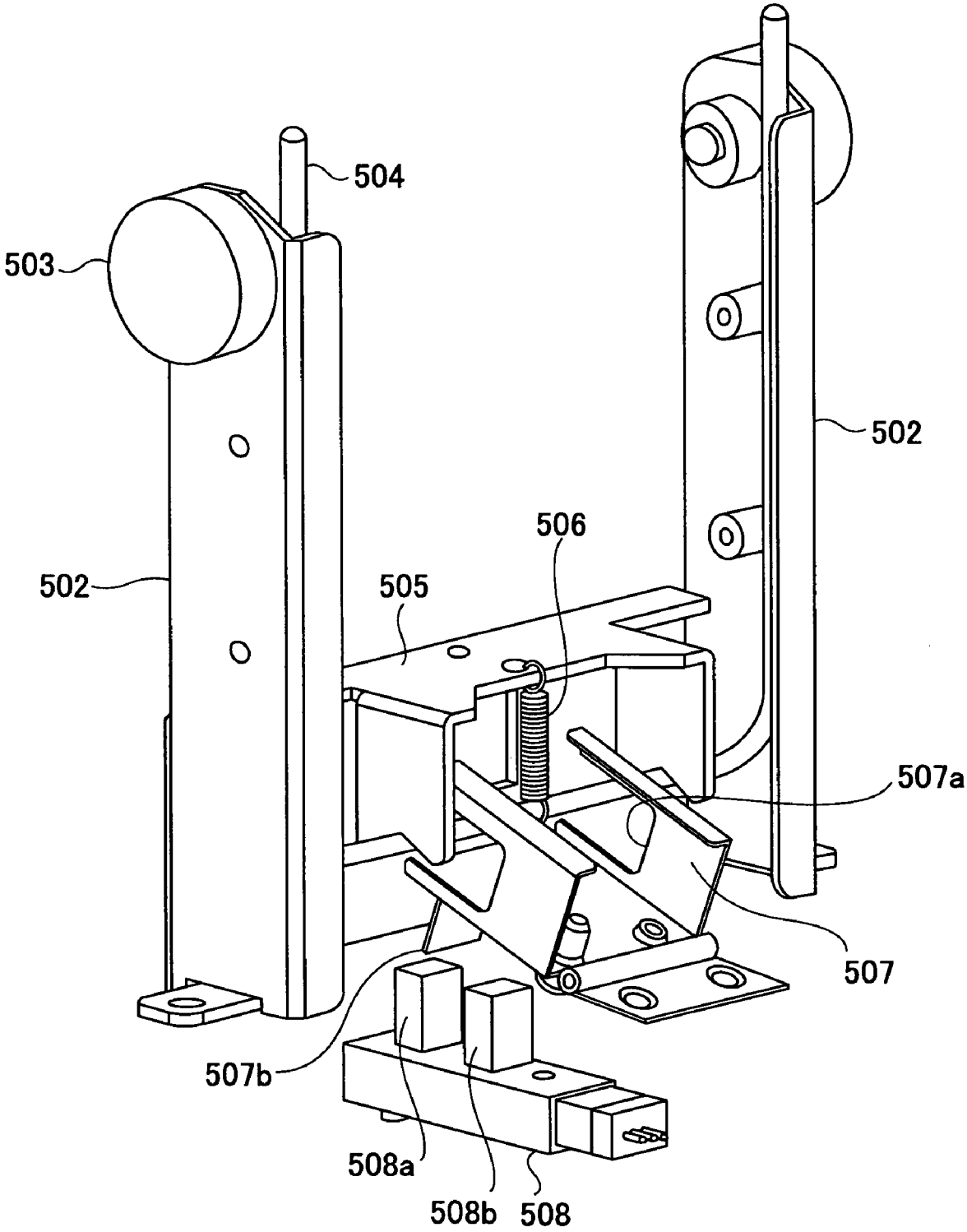
FIG. 11 is a diagram showing an example of the horizontal position detecting unit for the jackpot tray.

FIG. 11 shows an example of the horizontal position detecting unit. As shown, the generally U-shaped plunger 504 is arranged inside the pair of the supporting base parts 502 such that the plunger 504 can slide in the up/down direction. The upward force is exerted on the plunger 504 by the spring 506 interposed between the plunger 504 and the fixing piece 505, and the upper end of the plunger 504 projects from the upper end of the supporting base 502.

The configuration of the plunger 504 is not limited to that in the above embodiment. What is needed for the plunger 504 is just the function to transmit a displacement of the upper end of the plunger 504 when it is depressed.

Moreover, in the horizontal position detecting unit of FIG. 11, the cut-our portions 507*a* of the rocking piece 507 are engaged with the lower part of the plunger 504. When the plunger 504 is depressed downward, the rocking piece 507 is moved downward, and the shielding piece 507*b*, which is provided in the lower part of the rocking piece 507, enters the gap between the light emitting part 508*a* and the light receiving part 508*b* of the optical switch 508.

Figure 12:
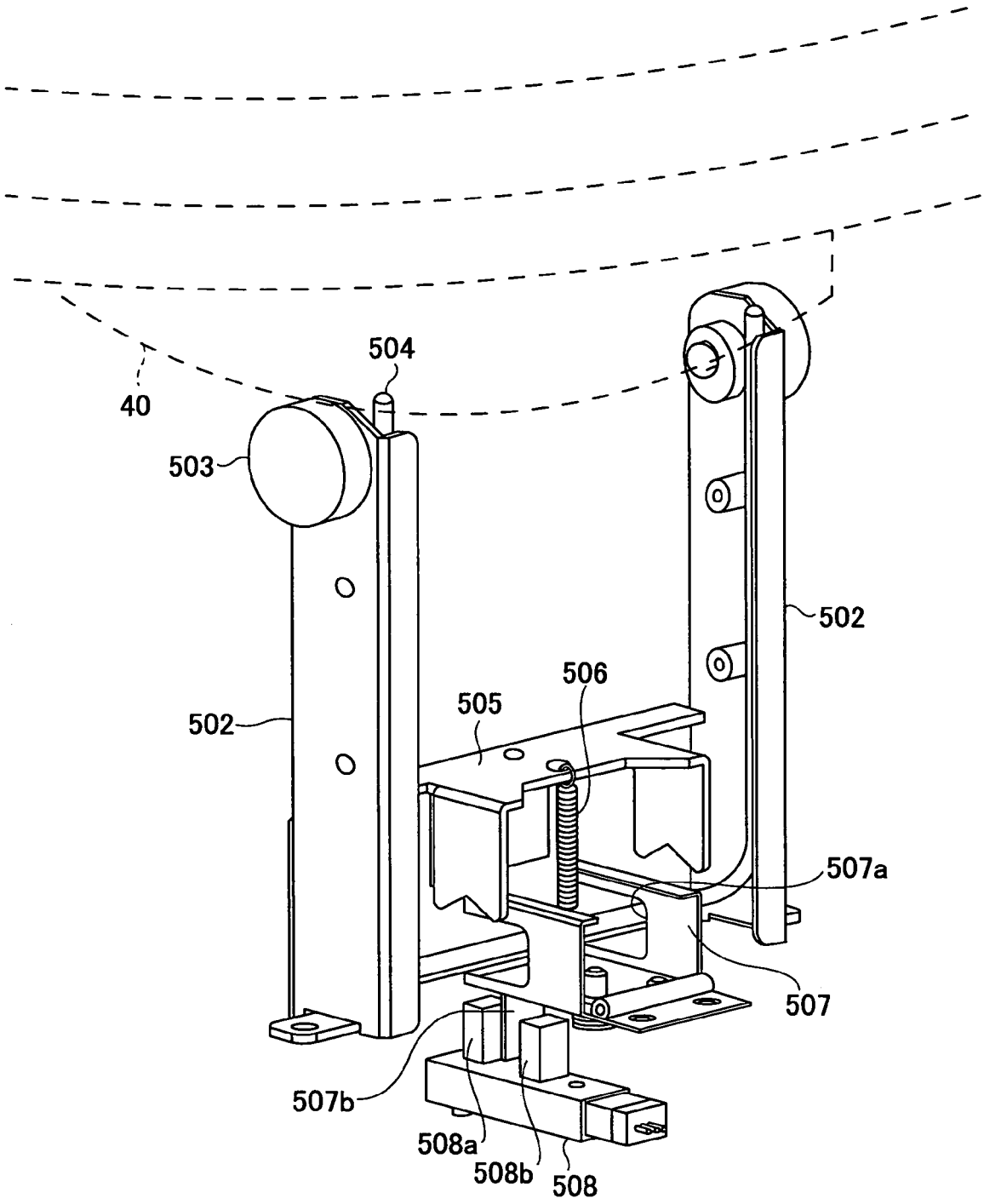
FIG. 12 is a diagram showing the state of the horizontal position detecting unit of FIG. 11 in which the jackpot tray is accommodated.

FIG. 12 shows the state of the horizontal position detecting unit in which the plunger 504 is depressed downward by the bottom of the jackpot tray 50 when the jackpot tray 40 is housed. In this state, the shielding piece 507*b* on the bottom of the rocking piece 507 enters the gap between the light emitting part 508*a* and the light receiving part 508*b* of the optical switch 508. A switching operation is performed by the optical switch 508, and this switching operation makes it possible to detect that the jackpot tray 40 is in the horizontal position correctly.

In the above-mentioned embodiment, the jackpot tray 40 is arranged so that the jackpot tray 40, when it is housed, should be in the horizontal position. For this reason, the detecting unit detects whether the jackpot tray 40 is in the horizontal position. However, even in the case where the jackpot tray 40 is arranged so that the jackpot tray 40 when it is housed should be inclined from the horizontal position, the detecting unit may be configured to detect whether the jackpot tray 40 is in the predetermined position, when it is housed.

Figure 13:
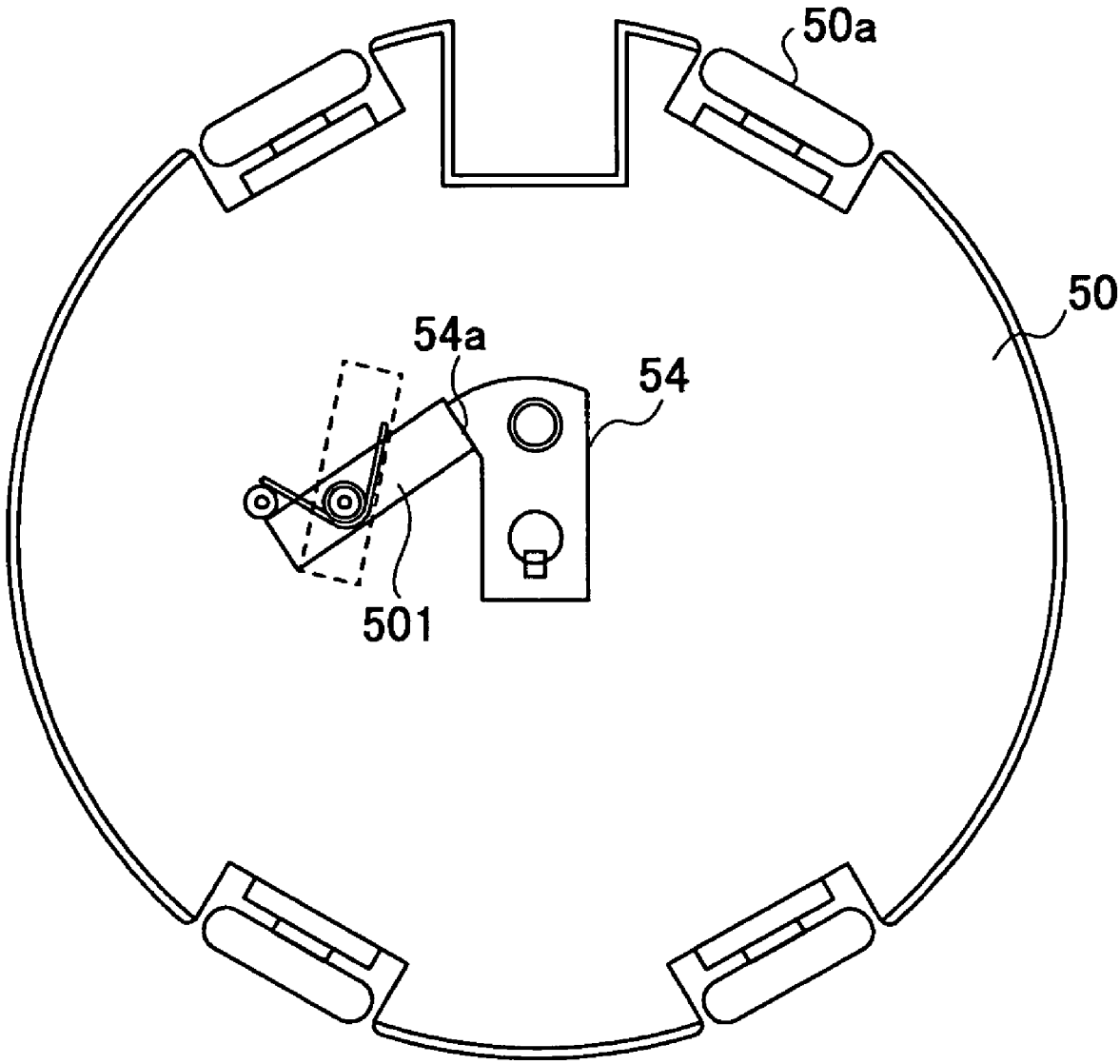
FIG. 13 is a diagram showing anther example of the drive mechanism of the jackpot tray.

FIG. 13 shows another example of the drive mechanism of the jackpot tray 40.

In the example of FIG. 10, one of the forward rotation operation and the reverse rotation operation of the motor 51 driving the jackpot tray 40 is selected by using the one-way clutch 53 provided on the drive shaft of the motor 51. In this example of FIG. 13, the latch 501 provided on the drive shaft of the motor 51 is used instead. Since the neighboring parts of the motor 51 and the mechanism part of the turntable 50 in this example are essentially the same as those shown in the example of FIG. 10, a description thereof will be omitted.

In the example of FIG. 13, the latch 501 is supported pivotally at the off-center position of the turntable 50, and the latch 105 is energized by a spring so that the latch 105 tends to face the center of the turntable 50 by the elastic force of the spring. The crank 54 is attached to the drive shaft of the motor 51, and the end face of the latch 501 touches the contact side face 54*a* on the outer periphery of the crank 54.

When the crank 54 is rotated counterclockwise in the drawing of FIG. 13, the latch 501 acts to prevent the crank 54 from being rotated independently, and the entire turntable 50 is rotated counterclockwise. On the other hand, when the crank 54 is rotated clockwise, the latch 501 does not act on the crank 54, and the crank 54 is rotated independently. In the latter case, the linkage mechanism for the inclination of the jackpot tray 40 can be driven.

Figure 14:
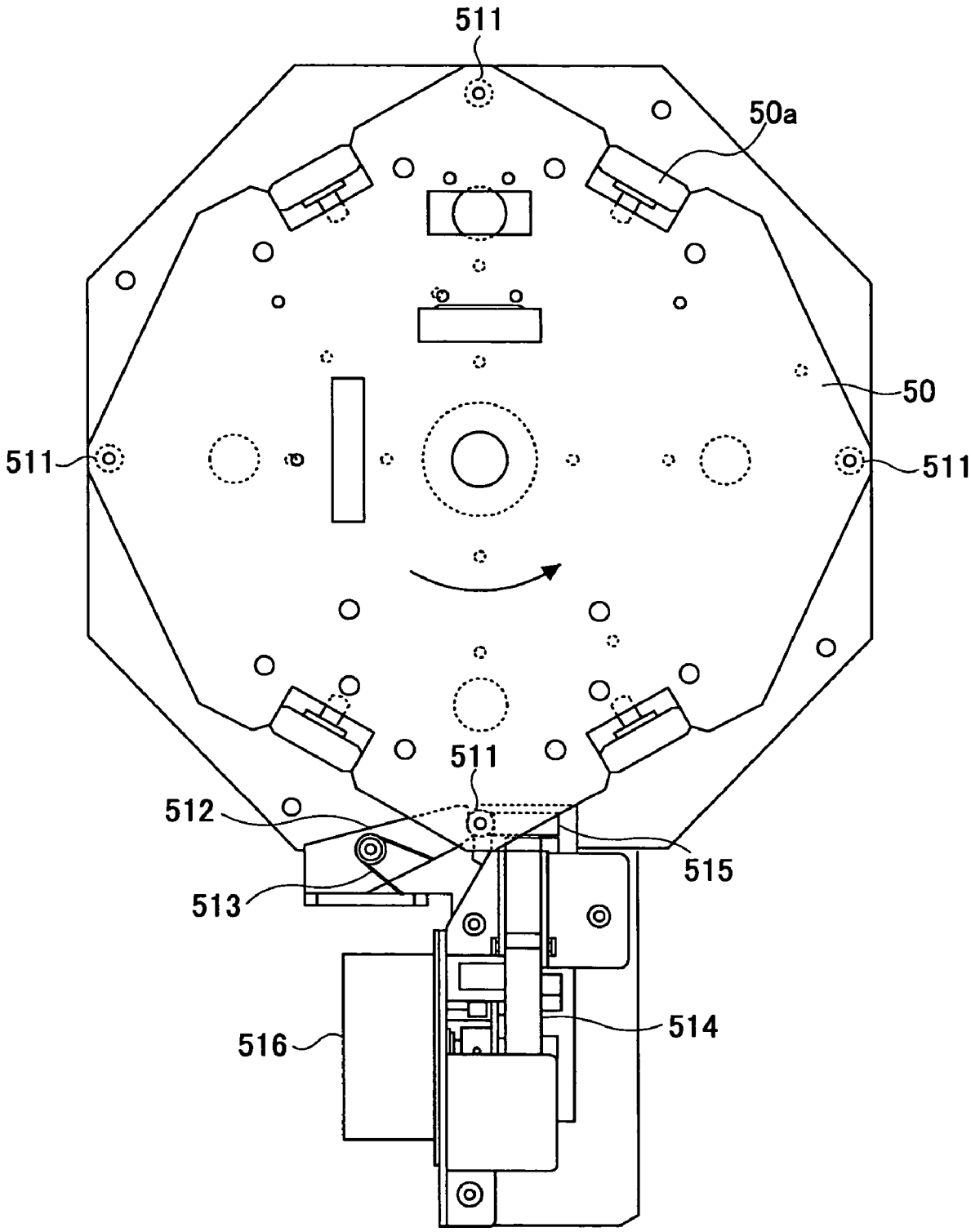
FIG. 14 is a diagram showing an example of the locking mechanism of the turntable.

FIG. 14 shows an example of the locking mechanism of the turntable 50.

In the examples of FIG. 10 and FIG. 13, the locking mechanism of the turntable 50 is not illustrated especially. However, if there is no locking mechanism of the turntable 50, the turntable 50 tends to move redundantly due to the inertial force when the rotating state of the turntable 50 is shifted to the stop state. There is a problem that the rotation of the turntable 50 must be stopped in advance of a predetermined stop position so as to absorb the inertial force. If a frictional load is provided on the turntable 50 invariably, the problem of inertia will be eliminated. However, the new problem, such as a torque loss of the motor or instable operation of the turntable due to changes of frictional load by aging, may arise. Thus, it is not preferred that a frictional load is provided on the turntable 50 invariably. Moreover, since the turntable 50 does move by the inertial force, there is a possibility of rattling of the drive mechanism when the jackpot tray 40 is inclined at the time of jackpot formation, which will cause shortening of the operational life of the mechanism part. This is not desirable for the appearance of the game apparatus.

To obviate the problem, the example of the locking mechanism, shown in FIG. 14, is configured so as to position or lock the turntable 50 certainly without using the frictional load. In the example of FIG. 14, the turntable 50 is provided in the shape of a polygon. Alternatively, the shape of the turntable 50 may be circular.

In the example of FIG. 14, the pins 511 which project downward from the back surface of the turntable 50 are arranged corresponding to the predetermined stop positions at which the turntable 50 should be positioned and stopped. The latch 512 and the roller 515 are provided at one corner of the peripheral part of the turntable 50 on the base 11, so that a corresponding one of the pins 511 are pinched between the latch 512 and the roller 515. The roller 515 is provided at the end of the lock arm 514.

Other projecting members may be used instead of the pins 511. The projecting direction of such projecting members is not limited to the downward perpendicular direction as shown in FIG. 14, and it may be the upward perpendicular direction or the lateral horizontal direction.

Figure 15:
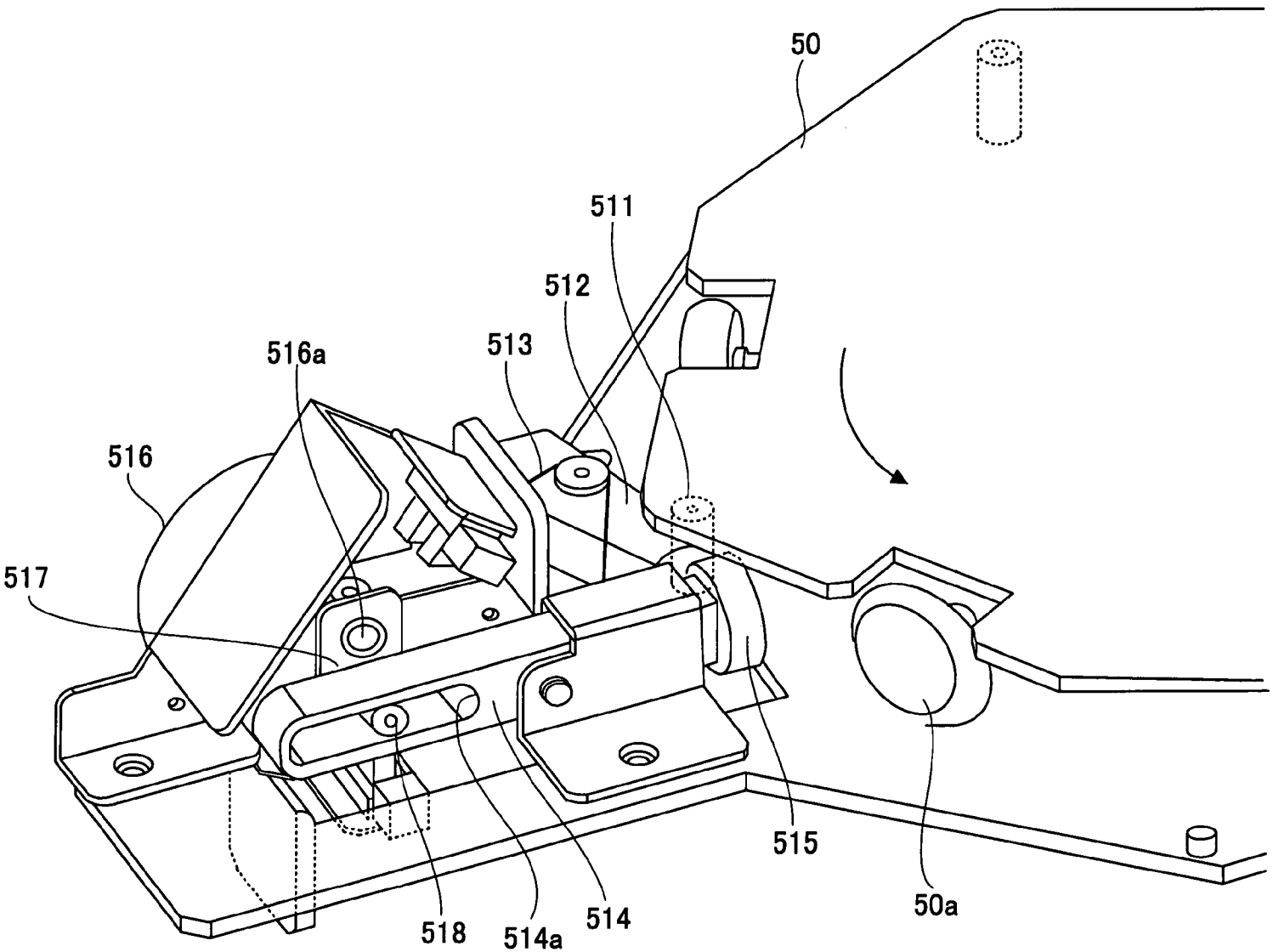
FIG. 15 is a partial enlarged view of the locking mechanism of FIG. 14.

FIG. 15 is a partial enlarged view of the locking mechanism of FIG. 14. As shown in FIG. 15, the latch 512 is supported pivotally such that the latch 512 is capable of rocking. The latch 521 is energized by the spring 513 such that the latch 512 tends to face the direction of the turntable 50 by the elastic force of the spring 513.

When the turntable 50 is rotated in the direction indicated by the arrow in FIG. 15, the pin 511 is moved to push the latch 512 in the outward direction. As soon as the pin 511 is separated from the end of the latch 512, the latch 512 is returned back toward the side of the pin 511 and brought in contact with the side of the pin 511.

In the meantime, the lock arm 514 in which the roller 515 is formed at the end of the lock arm 514 is supported pivotally near at its central part such that the lock arm 514 is capable of rocking. The roller 518 of the crank 517 is engaged with the guide hole 514*a* formed in the lock arm 514 on the opposite side to the roller 515. The crank 517 is attached to the rotation shaft 516*a* of the motor 516.

When the turntable 50 is rotated, the lock arm 514 is inclined with the roller 515 side being lowered, so that the roller 515 is in the position that it does not bar the passage of the pin 511 on the turntable 50. After the rotation of the turntable 50 is stopped, the pin 511 on the turntable 50 slightly overruns, and the reverse rotation of the turntable 50 causes the pin 512 on the turntable 50 to hit the latch 512, then the turntable 50 is stopped at the hit position. In the meantime, the lock arm 514 is returned to the horizontal position by the rotation of the motor 516, and the pin 511 on the turntable 50 is latched between the roller 515 and the latch 512 so that the locking operation for the turntable 50 is completed.

Accordingly, even if the turntable 50 slightly overruns due to the inertial force, it is possible to position and lock the turntable 50 at the predetermined stop position. It is no longer necessary to stop the rotation of the turntable 50 in advance of the predetermined stop position by fine adjustment, so as to absorb the inertial force. Moreover, rattling of the drive mechanism of the turntable 50 is eliminated by the completion of the locking operation, and deterioration of the mechanism part can be suppressed. This is also appropriate for the appearance of the game apparatus.

FIGS. 16A to 20C show other examples of the jackpot tray.

Figure 16A:
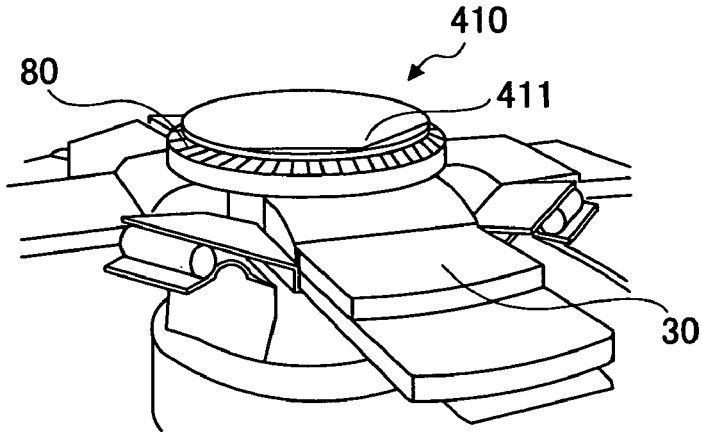
FIG. 16A, FIG. 16B and FIG. 16C are diagrams showing another example of the jackpot tray.
Figure 16B:
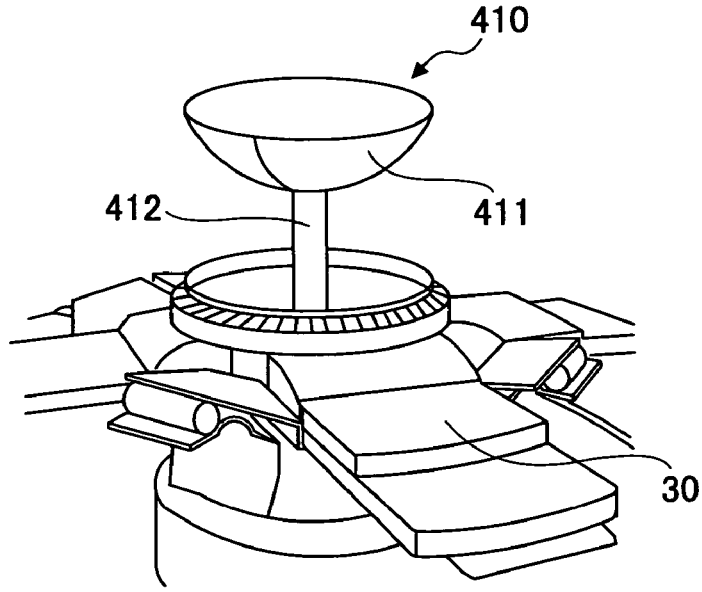
Figure 16C:
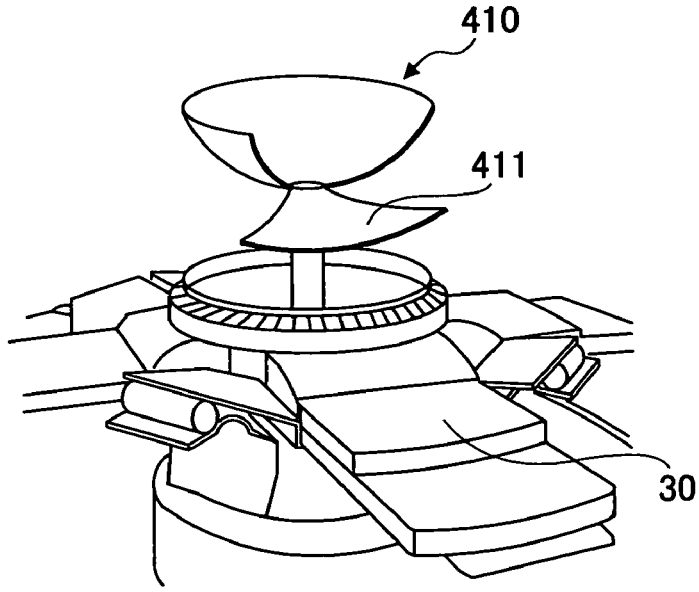

FIG. 16A, FIG. 16B and FIG. 16C shows the type of the jackpot tray in which the premium is dropped from the bottom of the jackpot tray. As shown, the jackpot tray 410 is provided with the open/close bottom part 411, and opening and closing of the open/close bottom part 411 is possible. When the jackpot formation does not occur, the open/close bottom part 411 is in the closed state. In this state, as shown in FIG. 16A, the jackpot tray bottom is housed in the lamp ring 80, and the jackpot tray 410 is being rotated. The rotation of the turntable 40 is necessary to keep the premium stored in the jackpot tray 410 from deviating.

When the jackpot formation occurs, the rotation of the turntable 40 is stopped at the position confronting the player concerned. In this state, as shown in FIG. 16B, the jackpot tray 410 is lifted to the predetermined height by the lifting mechanism 412. And the open/close bottom part 411 is opened as shown in FIG. 16C, and the premium stored in the jackpot tray 410 is dropped on the pusher 30.

FIG. 17A, FIG. 17B, FIG. 17C and FIG. 17D show the type of the jackpot tray in which the premium is dropped from the bottom of the jackpot tray similarly.

Figure 17A:
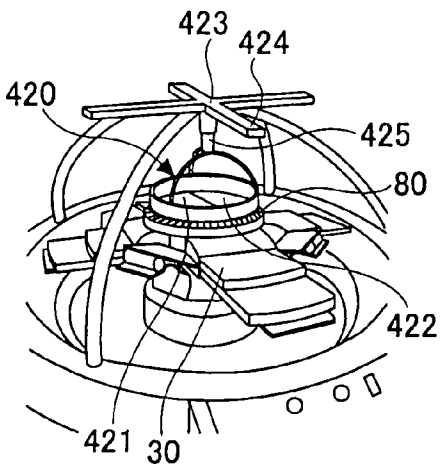
FIG. 17A, FIG. 17B, FIG. 17C and FIG. 17D are diagrams showing another example of the jackpot tray.

As shown, the jackpot tray 420 is provided on the bottom with the open/close bottom parts 421 and 422 which can be opened and closed. The hanging part 425 is connected to the central part of the mutually intersecting rails 424 in the frame 423. When the jackpot formation does not occur, the open/close bottom parts 421 and 422 are in the closed state. In this state, as shown in FIG. 17A, the open/close bottom parts 421 and 422 are hanged down to the position in the neighborhood of the lamp ring 80 through the hanging part 425, and the jackpot tray 420 is rotated.

Figure 17B:
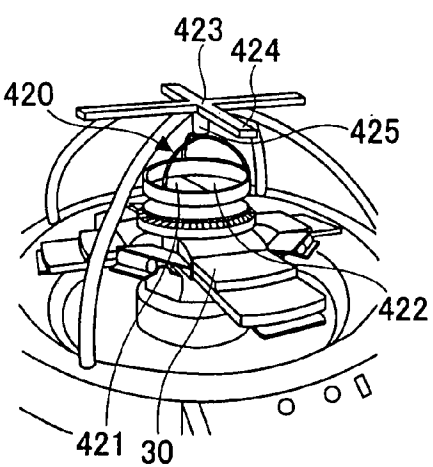
Figure 17C:
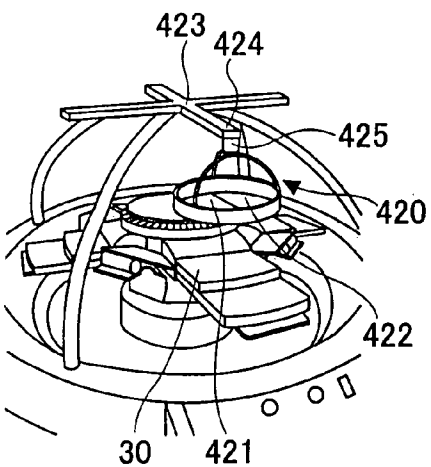
Figure 17D:
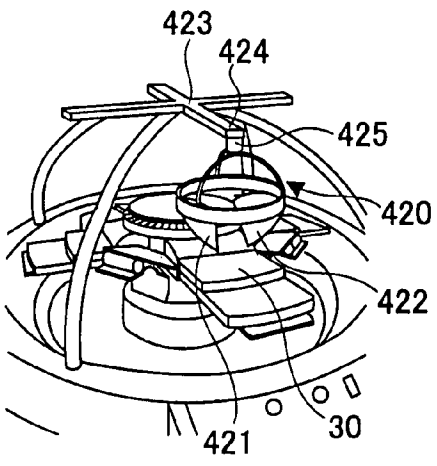

When the jackpot formation occurs, the rotation of the jackpot tray 420 is stopped to the position confronting the player concerned. In this state, as shown in FIG. 17B, the hanging part 425 is shrunk and the jackpot tray 420 is lifted to the predetermined height by the hanging part 425. And the hanging part 425 is moved to the direction of the player concerned along the rail 424 with the hanged state being maintained as shown in FIG. 17C. Then the open/close bottom parts 421 and 422 are opened, as shown in FIG. 17D, and the premium stored in the jackpot tray 420 is dropped on the pusher 30.

Figure 18A:
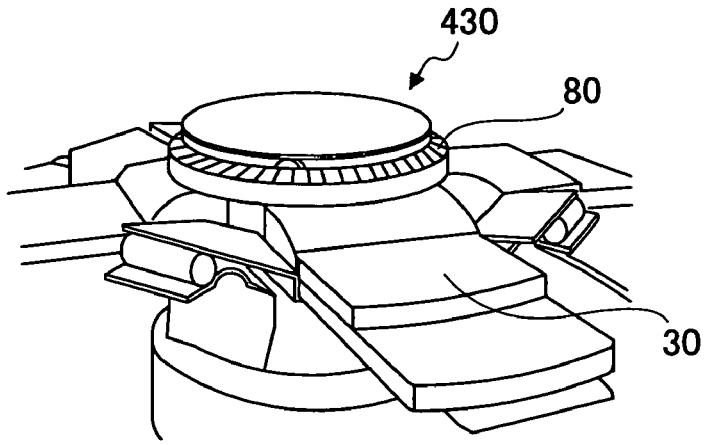
FIG. 18A, FIG. 18B and FIG. 18C are diagrams showing another example of the jackpot tray.
Figure 18B:
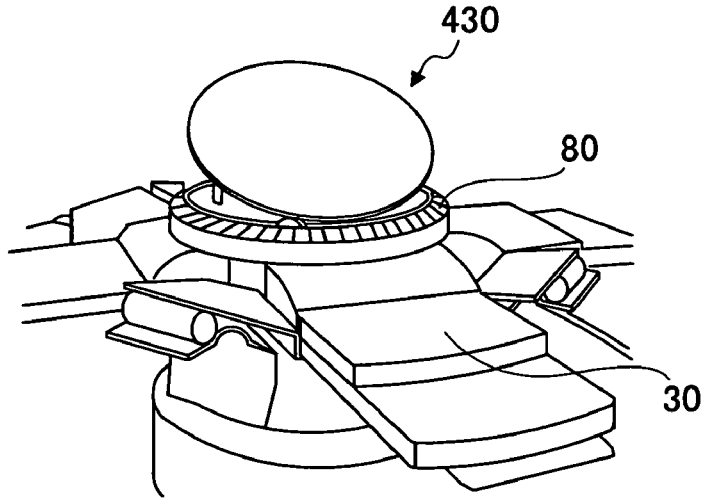
Figure 18C:
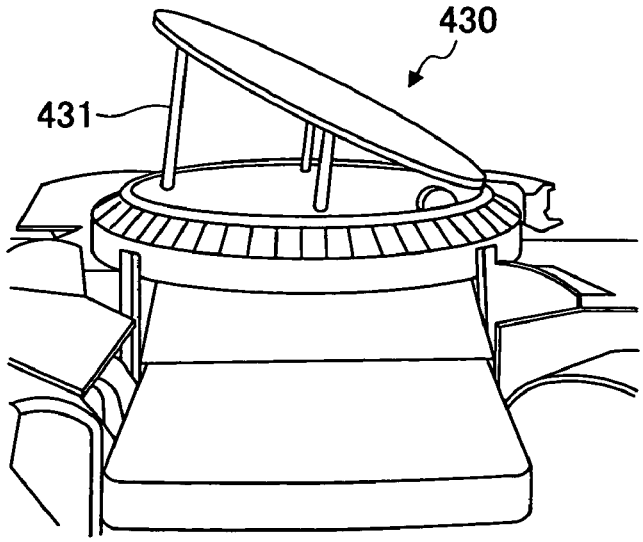

FIG. 18A, FIG. 18B and FIG. 18C show the type of the jackpot tray in which the premium simply slides down. As shown, the jackpot tray 430 is arranged in a plate-like formation. When the jackpot does not occur, the jackpot tray 430 is in the horizontal position (with no inclination) near the lamp ring 80 as shown in FIG. 18A, and the jackpot tray 430 is rotated in this state.

When the jackpot formation occurs, the rotation of the jackpot tray 430 is stopped to the position confronting the player concerned. In this state, as shown in FIG. 18B, the jackpot tray 430 is inclined, so that the premium stored in the jackpot tray 430 slides down on the pusher 30. FIG. 18C is a side view of the jackpot tray 430 showing the state in which the jackpot tray 430 is inclined. As shown in FIG. 18C, the leg 431 is raised upward and the jackpot tray 430 is inclined.

Figure 19A:
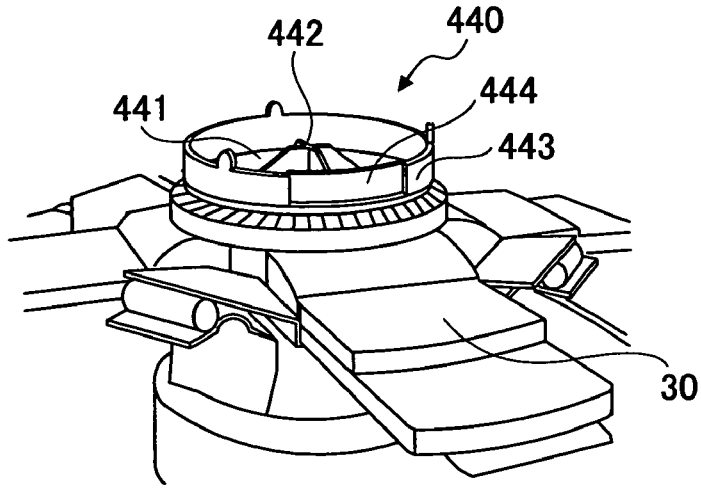
FIG. 19A, FIG. 19B and FIG. 19C are diagrams showing another example of the jackpot tray.
Figure 19B:
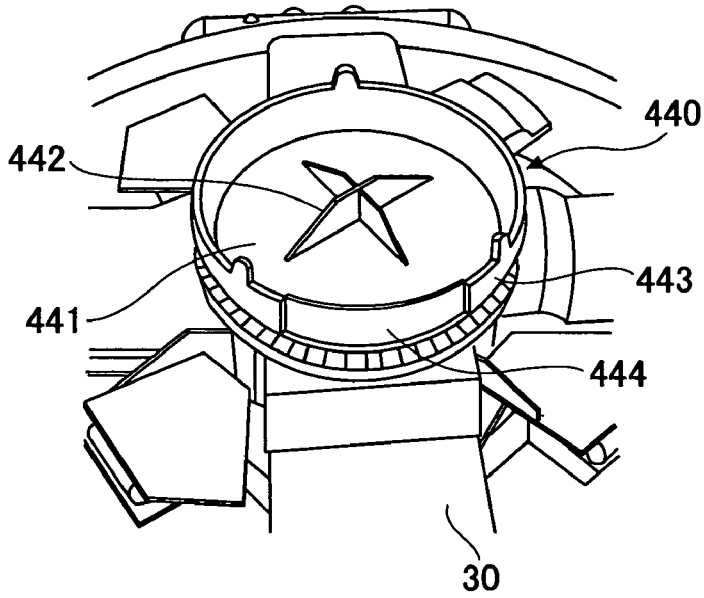
Figure 19C:
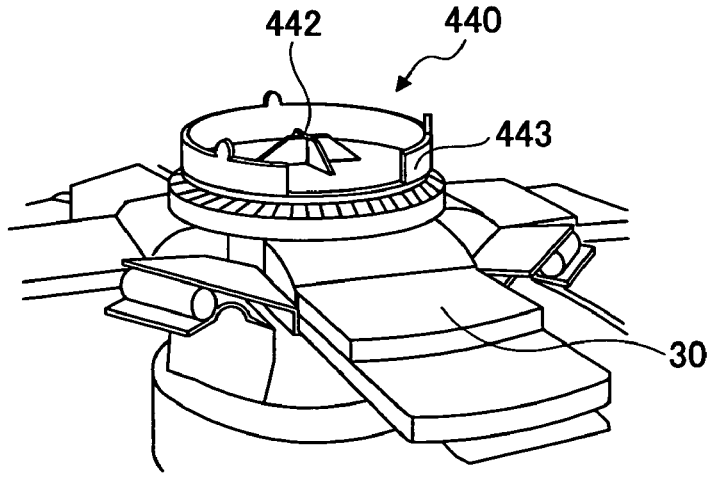

FIG. 19A, FIG. 19B and FIG. 19C show the type of the jackpot tray in which the premium is ejected using the centrifugal force. As shown, the jackpot tray 440 is provided with the bottom plate 441 which is rotatable independently, and the vanes 442 are formed on the bottom plate 441. A part of the side wall 443 of the jackpot tray 440 is formed into the open/close door 444 which can be opened and closed.

In the normal condition in which the jackpot formation does not occur, as shown in FIG. 19A, the open/close door 444 is in the closed state and the whole jackpot tray 440 is rotated. At this time, the bottom plate 441 is rotated together with the jackpot tray 440, but the bottom plate 441 is not rotated independently. FIG. 19B shows the state of the jackpot tray 440 when viewed from the upper part.

When the jackpot formation occurs, the rotation of the jackpot tray 440 is stopped to the position confronting the player concerned. In the meantime, the independent rotation of the bottom plate 441 is started, and when the rotation speed reaches a predetermined value, the open/close door 444 slides into the side wall 443 and it is in the opened state as shown in FIG. 19C. The centrifugal force is given to the premium by using the vanes 442, and the premium is ejected to the pusher 30 side.

Figure 20A:
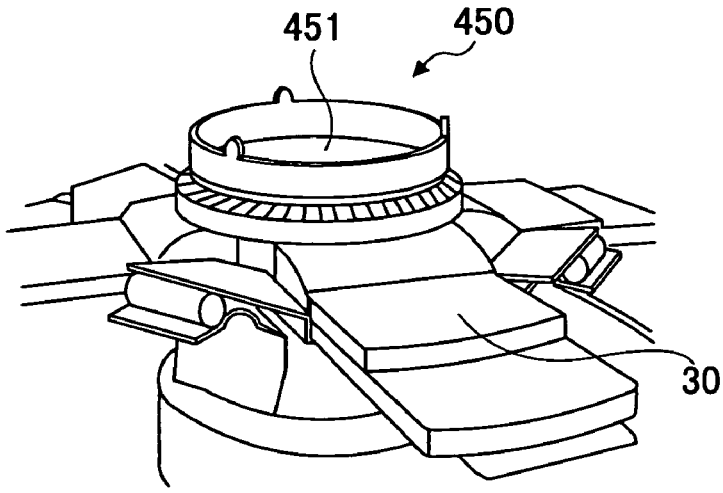
FIG. 20A, FIG. 20B and FIG. 20C are diagrams showing another example of the jackpot tray.
Figure 20B:
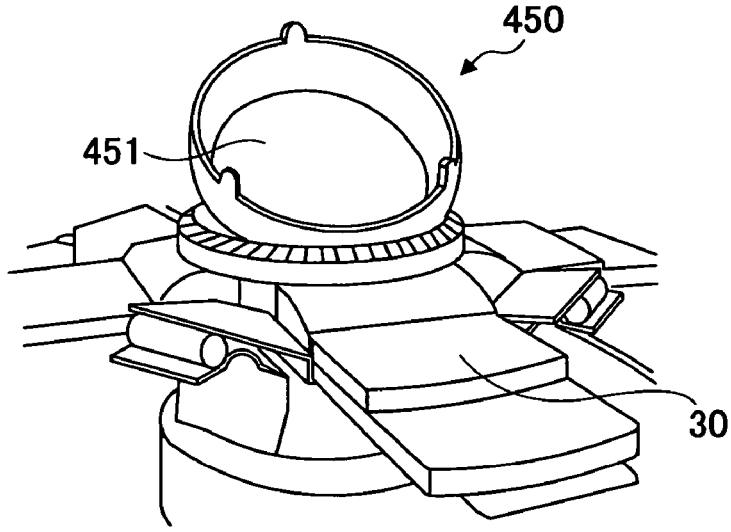
Figure 20C:
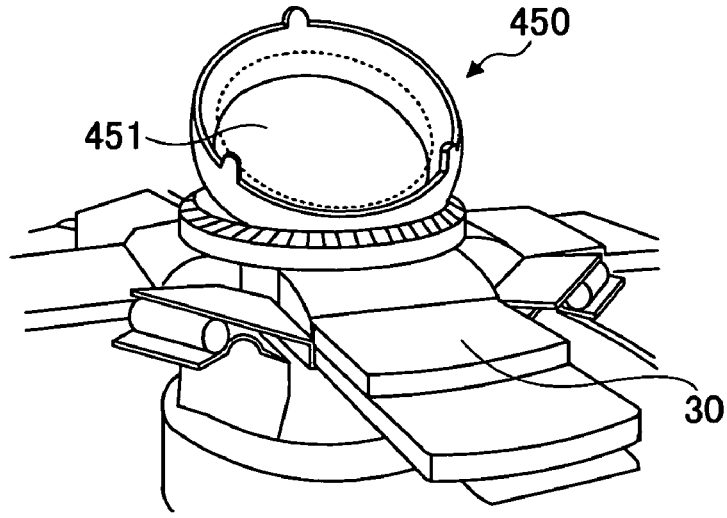

FIG. 20A, FIG. 20B and FIG. 20C show the type of the jackpot tray in which the jackpot tray is inclined and the premium is vibrated by the bottom plate and smoothly ejected. The bottom plate 451 of the jackpot tray 450 is adapted for vibrating the premium in the jackpot tray 450.

When the jackpot formation does not occur, the jackpot tray 450 is in the horizontal position (with no inclination) near the lamp ring 80, and the jackpot tray 450 is rotated, as shown in FIG. 20A. When the jackpot formation occurs, the rotation of the jackpot tray 450 is stopped to the position confronting the player concerned. In this state, as shown in FIG. 20B, the jackpot tray 450 is inclined. Furthermore, as shown in FIG. 20C, the vibration of the bottom plate 451 is started, and the premium stored in the jackpot tray 450 is smoothly ejected to the pusher 30 side.

Figure 21:
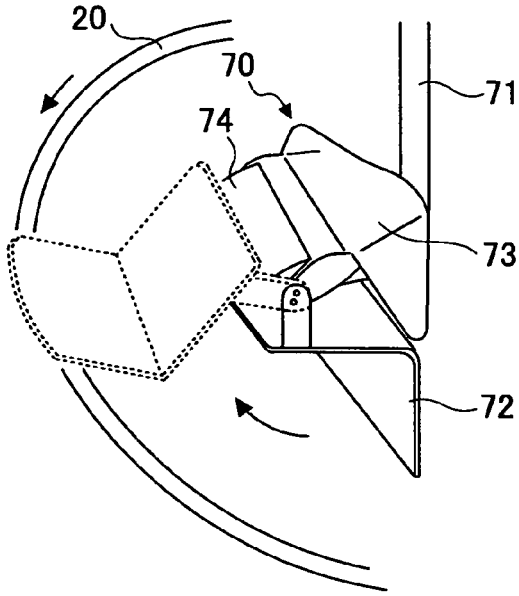
FIG. 21 is a diagram showing the state of the arm in which the premium is scooped up.
Figure 22:
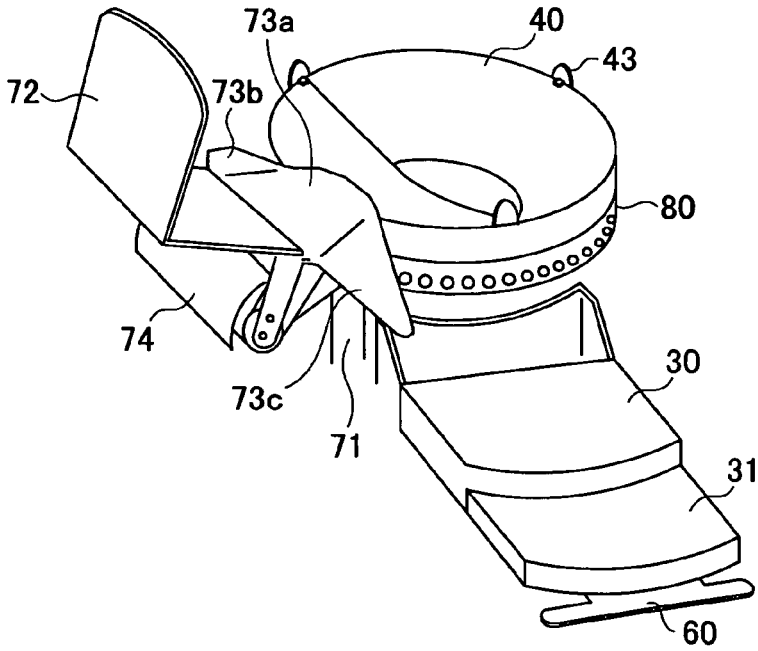
FIG. 22 is a diagram showing the state of the arm in which the premium is dropped.

FIG. 21 and FIG. 22 show the composition of the arm 70. FIG. 21 shows the state of the arm 70 in which the premium is scooped up, and FIG. 22 shows the state of the arm 70 in which the premium is dropped.

As shown in FIGS. 21 and 22, the arm 70 can be moved up and down through the rail-like lifting mechanism 71, and the shovel 72 which scoops up the premium is rotatably attached at the leading edge of the arm 70. The shovel 72 can be rotated by the motor provided inside the body 74.

The distribution board 73 is attached to the upper surface of the arm 70, and this distribution board 73 includes the flat portion 73*a*, the upwardly curved lug portion 73*b* on one side of the flat portion 73*a*, and the downwardly curved lug portion 73*c* on the other side of the flat portion 73*a*. Alternatively, the upwardly curved lug portion 73*b* may be omitted from the distribution board 73.

Figure 23A:
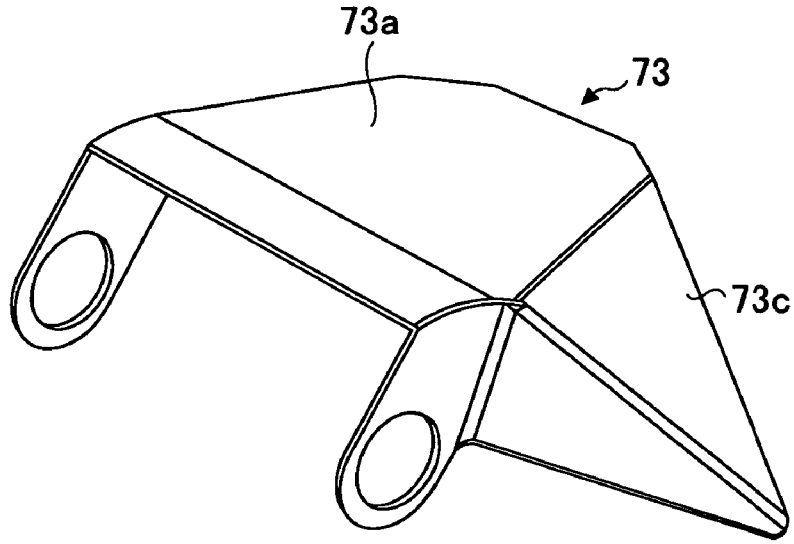
FIG. 23A and FIG. 23B are diagrams showing another example of the distribution board.
Figure 23B:
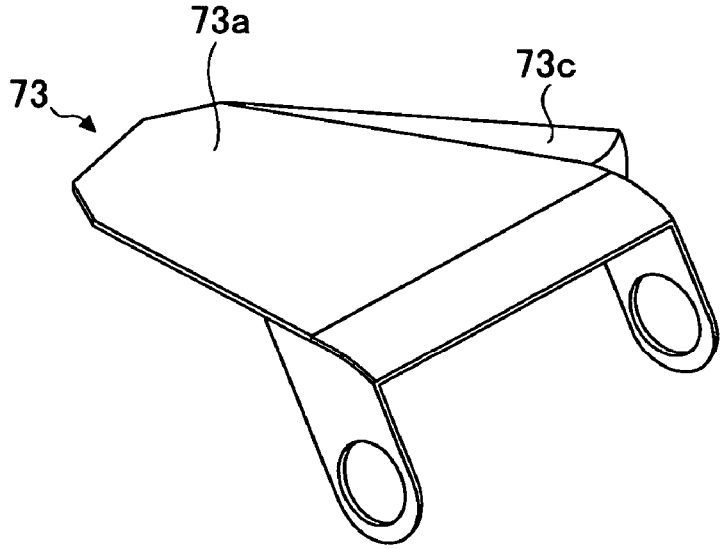

FIG. 23A shows another example of the distribution board 73 in which the upwardly curved lug portion is omitted, and FIG. 23B shows the distribution board of FIG. 23A when viewed from the left-hand side.

When scooping up the premium, the leading edge of the shovel 72 is in the position facing the bottom, and the leading edge of the shovel 72 is lowered to the position just before touching the surface of the turntable 20 by the lifting mechanism 71. In this state, the shovel 72 is rotated so that the leading edge of the shovel 72 is moved so as to trace the curved surface of the turntable 20, and the premium can be scooped up with the shovel 72.

When dropping the premium, the shovel 72 in which the premium is scooped up is lifted to the position above the jackpot tray 40 by the lifting mechanism 71, and the shovel 72 is rotated further so that the premium slides down to the jackpot tray 40.

At this time, the distribution board 73 is provided in the drop route of the premiums, and the premiums are divided by the distribution board 73 into the premiums which are dropped on the jackpot tray 40 via the flat portion 73*a*, and the premiums which are dropped on the pusher 30, confronting the player who is operating the arm 70, via the downwardly curved lug portion 73*c*.

In the example of FIG. 22, falling of the premiums from the shovel 72 to the area of the neighboring player on the left-hand side of the player concerned is positively prevented by the upwardly curved lug portion 73*b* on the left-hand side of the distribution board 73. Alternatively, the lug portion 73*b* may be omitted from the distribution board 73, and such distribution board 73 is satisfactory in practice.

In the example of FIG. 22, the guard parts 43 are arranged on the upper peripheral edge of the jackpot tray 40 at suitable intervals. The number of the premiums being dropped on the pusher 30 can be increased by choosing the timing to drop the premiums at the player's own discretion and dropping them so as to hit the guard parts 43.

Figure 24:
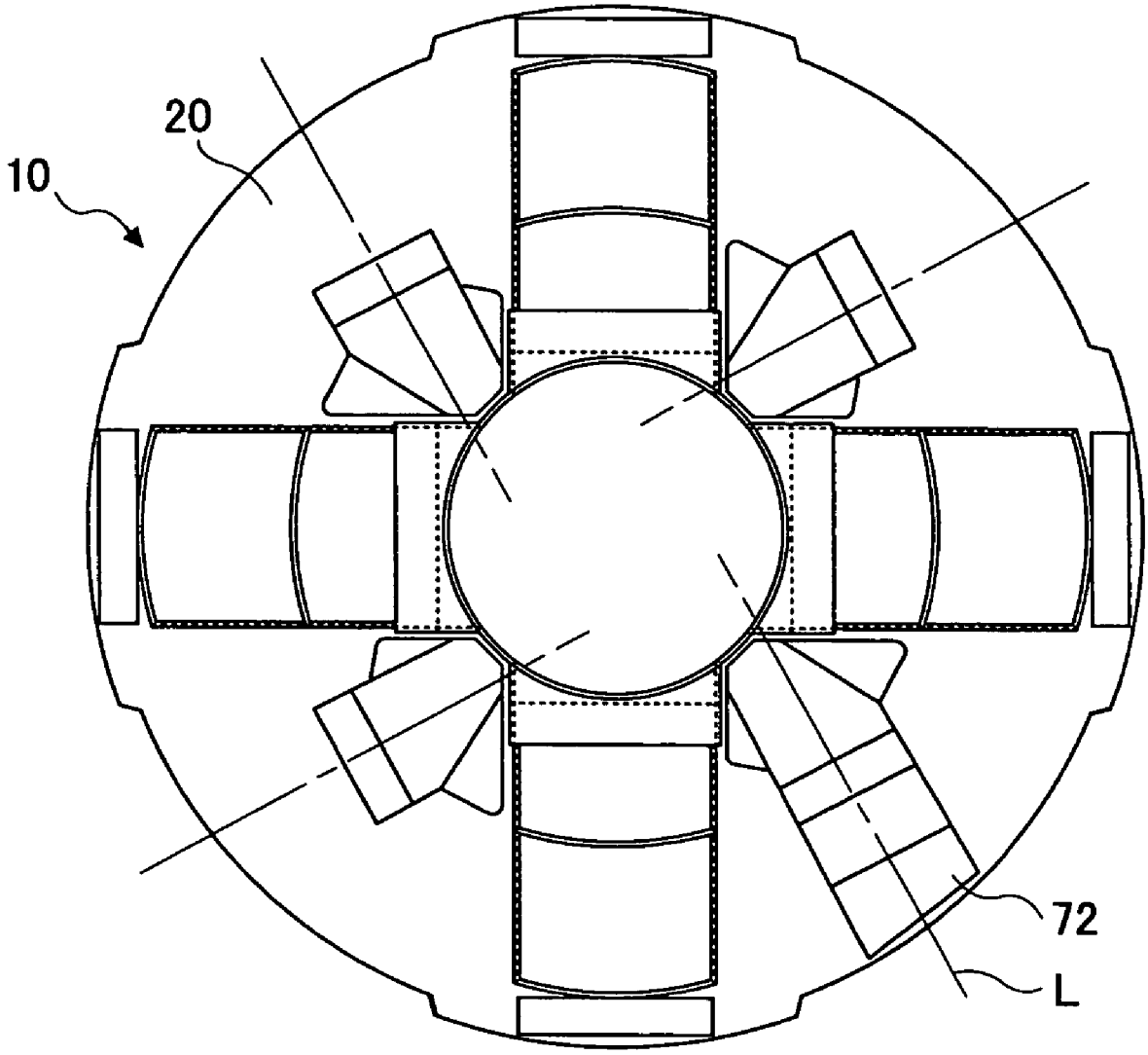
FIG. 24 is a diagram showing the rotation direction of the shovel.

FIG. 24 shows the rotation direction of the shovel 72 at the leading edge of the arm 70. As shown, the shovel 72 is rotated along with the straight line L extending from the off-center position of the turntable 20 to the outside, in order to distribute the scooped-up premiums to both the jackpot tray 40 and the pusher 30.

Figure 25:
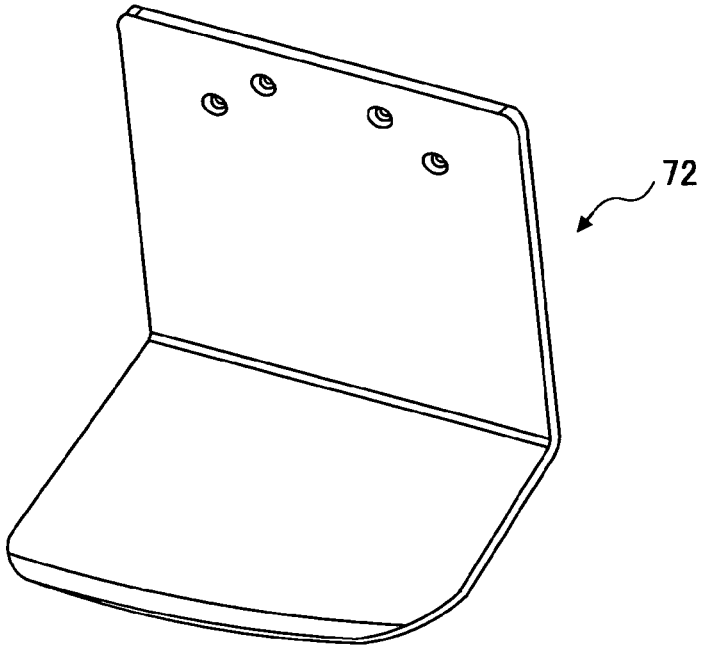
FIG. 25 is a diagram showing an example of the shovel at the leading edge of the arm.

For this purpose, the leading edge of the shovel 72 is formed as shown in FIG. 25 such that the right-hand side is shorter than the left-hand side. Hence, there may be no gap between the turntable 20 and the shovel 72.

Figure 26:
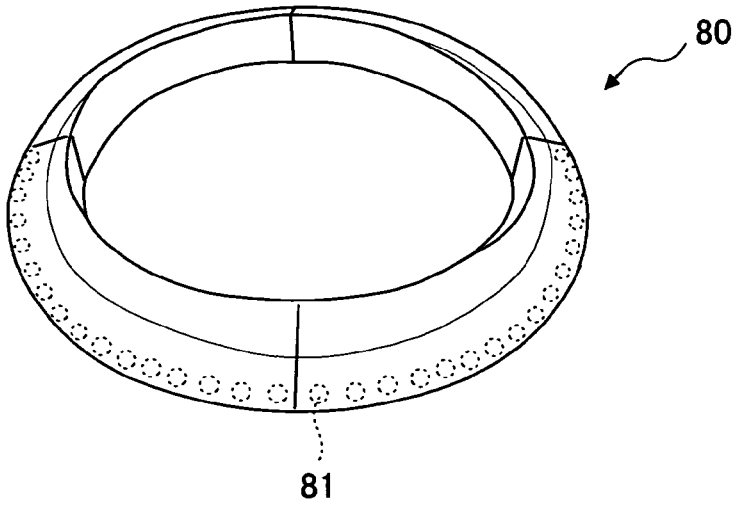
FIG. 26 is a diagram showing an example of the lamp ring.

FIG. 26 shows an example of the lamp ring 80. As shown, the outside of the lamp ring 80 is formed by the translucent plastic case, and the lamp ring 80 is divided into a plurality of areas for the respective players. The plurality of lamps 81, such as LEDs, are arranged in a ring formation in the inside of the lamp ring 80 ranging over the divided areas. Lighting of the lamps 81 of the lamp ring 80 is controlled by the controlling circuit part (which is not shown).

Figure 27:
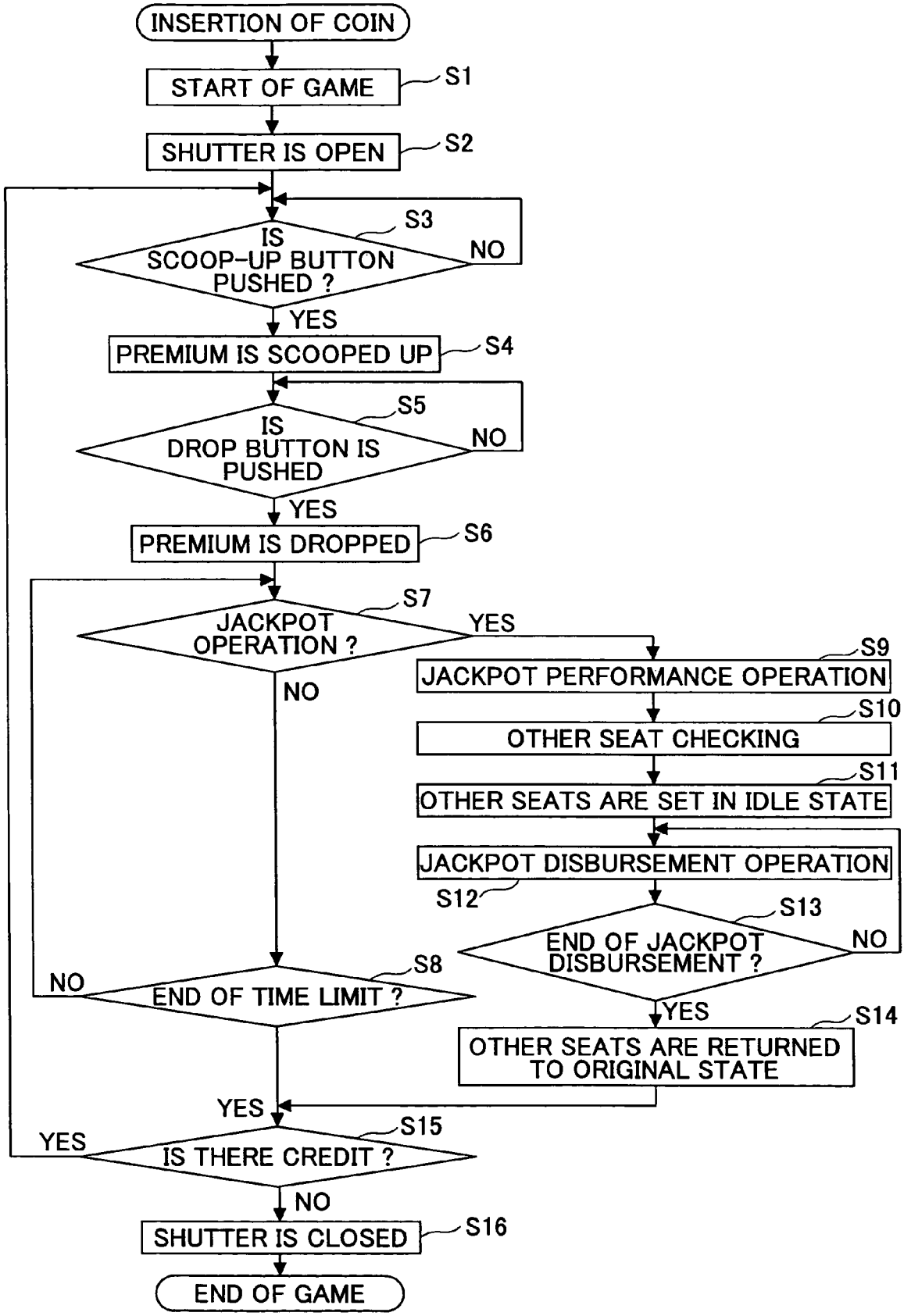
FIG. 27 is a flowchart for explaining operation of the article acquisition game apparatus in an embodiment of the invention.
Figure 28:
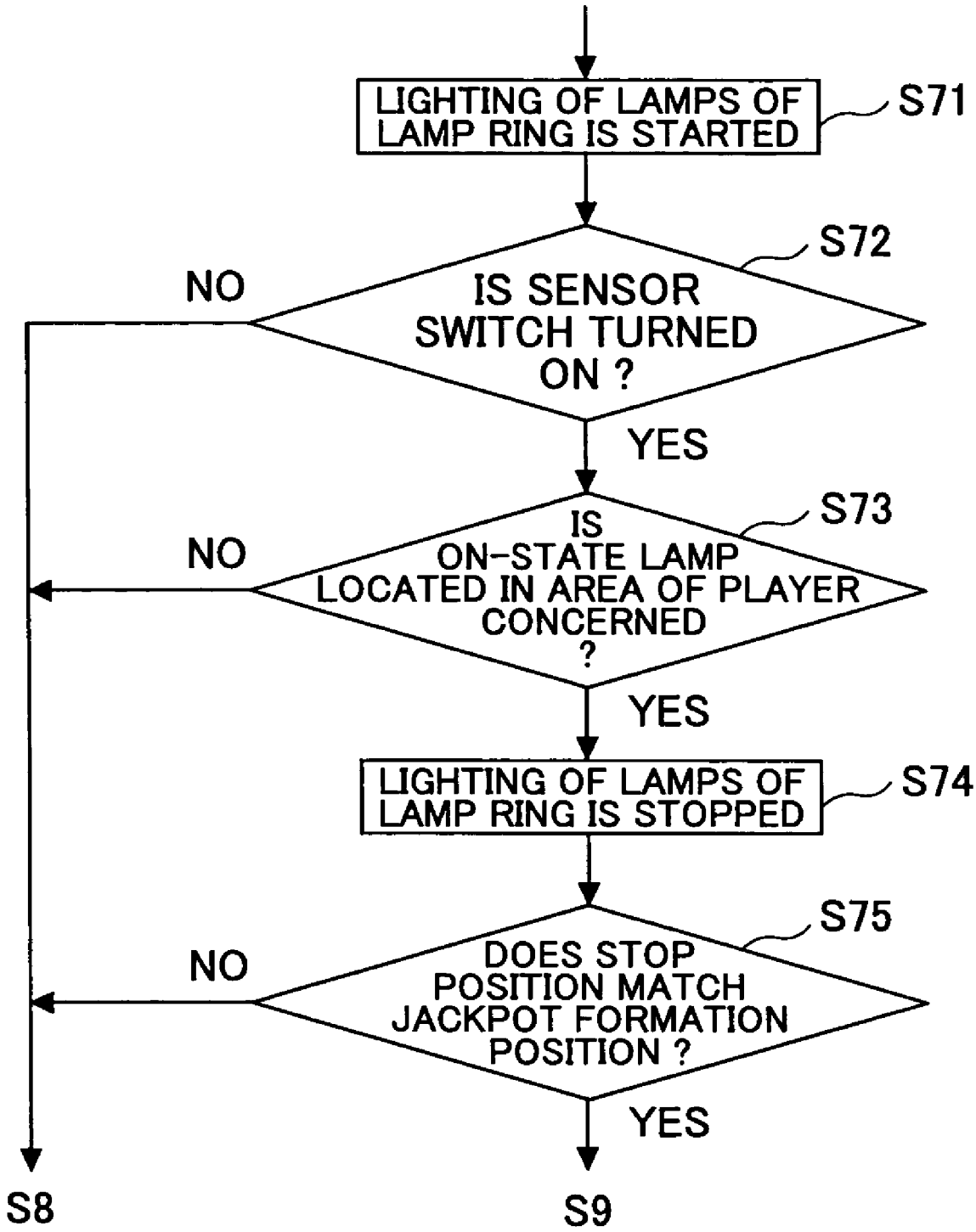
FIG. 28 is a flowchart for explaining the process of the detection of jackpot operation in the flowchart of FIG. 27.
Figure 29:
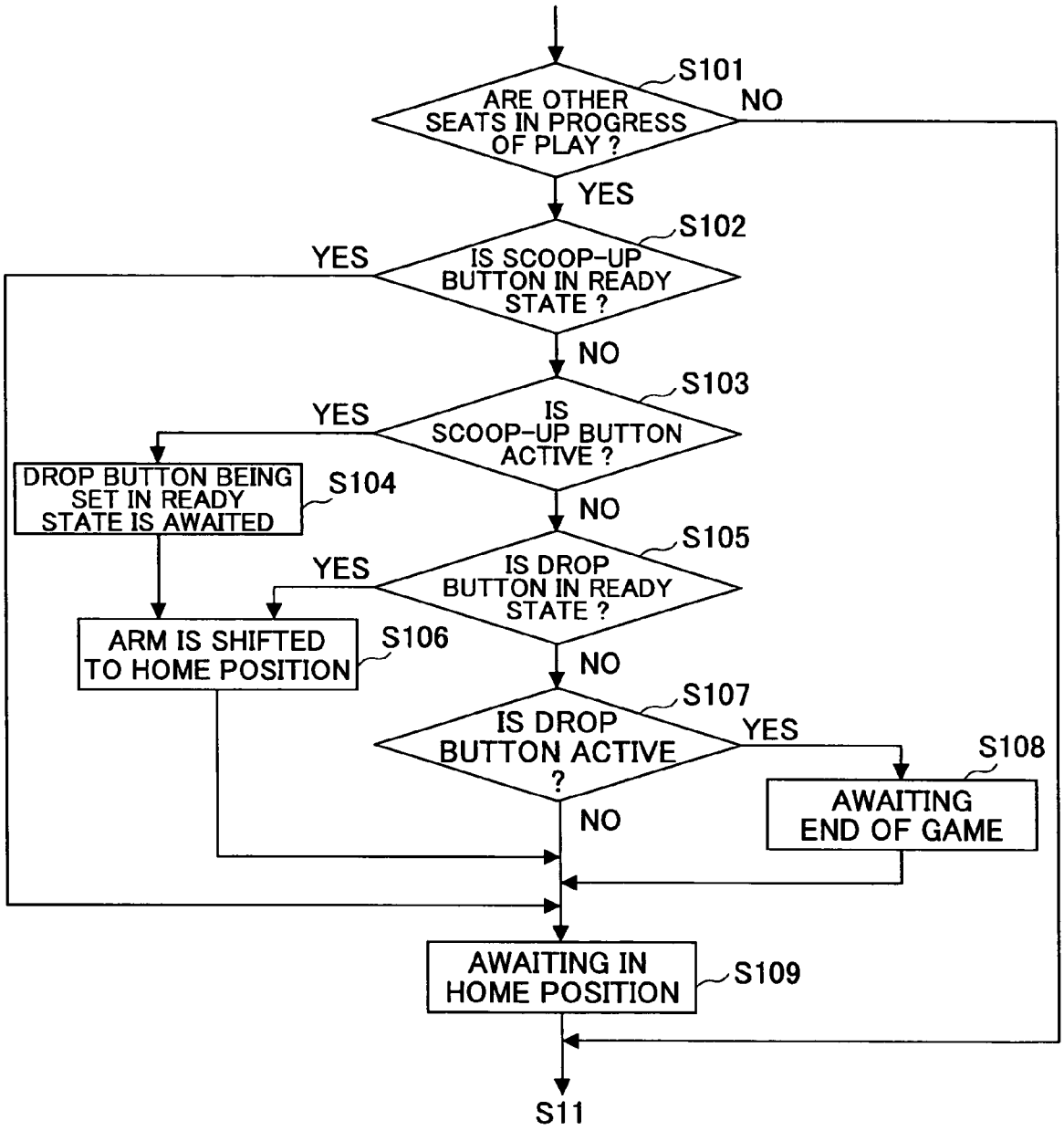
FIG. 29 is a flowchart for explaining the process of other seat checking in the flowchart of FIG. 27.

FIGS. 27-29 are flowcharts for explaining operation of the article acquisition game apparatus 10 in an embodiment of the invention. In the following, the operation of the article acquisition game apparatus 10 at the time of game execution will be explained with reference to FIGS. 27-29.

As shown in FIG. 27, the execution of the game is started by inserting of a coin into the coin slot 14 (FIG. 1, FIG. 2) by the player (step S1).

Upon start of the game, the shutter 18 (FIG. 2) of the player concerned is open (step S2).

Subsequently, it is detected whether the scoop-up button 15 is pushed (step S3), and the loop is performed until the scoop-up button 15 is pushed.

When it is detected that the scoop-up button 15 is pushed (YES of step S3), scooping up of the premiums using the arm 70 (FIG. 21) is performed (step S4).

Subsequently, it is detected whether the drop button 16 is pushed (step S5), and the loop is performed until the drop button 16 is pushed.

When it is detected that the drop button 16 is pushed (YES of step S5), the drop operation of the premiums using the arm 70 (FIG. 22) is performed (step S6). Thereby, the premiums fall to both the jackpot tray 40 and the pusher 30 of the player concerned.

Since the reciprocating sliding motion of the pusher 30 is continued during the game, the premiums dropped on the pusher 30 are pushed out to the premium outlet 17 direction. After a certain number of premiums are accumulated on the pusher 30, they will be dropped from the end of the fixed stand 31 to the premium outlet 17, so that the premiums can be acquired.

Subsequently, it is detected whether the operation of jackpot (JP) should be activated (step S7). When the result of the detection at step S7 is negative (NO of step S7), it is detected whether the predetermined time limit ends (step S8). When the result of the detection at step S8 is negative, the detection of the jackpot operation at step S7 is repeated.

FIG. 28 is a flowchart for explaining the process of the detection (step S7) of the jackpot operation. First, in the flowchart of FIG. 28, the lamps 81 of the lamp ring 80 are sequentially turned on so that lighting of the lamps 81 occurs around the circumference of the lamp ring 80 (step S71).

Subsequently, it is detected whether a detection signal (ON) is outputted by the sensor switch 60 due to the falling of a premium to the premium outlet 17 (step S72).

Alternatively, the timing to activate the jackpot operation may be determined by another factor than the timing of falling of the premium. For example, the jackpot operation may be activated the instant a given period of time has elapsed after the insertion of the coin, or it may be activated at random timing.

When the detection signal is outputted by the sensor switch 60 (YES of step S72), it is detected whether the turned-on lamp 81 of the lamp ring 80 is located in the area of the player concerned (step S73).

When the turned-on lamp 81 is located in the area of the player concerned (YES of step S73), the sequential lighting of the lamps 81 is stopped (step S74).

However, when the location of the turned-on lamp 81 does not hit the jackpot, only the lamp 81 at the location where a reaction takes place blinks and the sequential lighting is not stopped.

Figure 30:
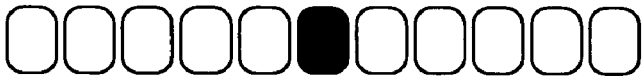
FIG. 30 is a diagram showing the lamp position of jackpot formation.

And it is detected whether the stopped position (or the location of the turned-on lamp) matches a predetermined position of jackpot formation (step S75). For example, the jackpot formation position is, as shown in FIG. 30, provided in the center of the area of the player concerned. If the stopped position matches the jackpot formation position, it is determined that and a jackpot will be materialized.

If the jackpot formation occurs (YES of step S75), the control is shifted to the jackpot performance operation (step S9) in the flowchart of FIG. 27.

On the other hand, when no detection signal is outputted by the sensor switch 60 (NO of step S72), or when the turned-on lamp 81 is not located in the area of the player concerned (NO of step S73), or when the stopped position is not the predetermined position of the jackpot formation (NO of step S75), the control is shifted to the detection (step S8) of the end of the time limit in the flowchart of FIG. 27.

Referring back to FIG. 27, when the jackpot formation occurs (YES of step S7), the jackpot performance operation using sound and light is carried out (step S9).

Subsequently, the checking of the states of other player seats (other seat checking) is performed (step S10).

FIG. 29 is a flowchart for explaining the process of the other seat checking (step S10) in the flowchart of FIG. 27. First, in the flowchart of FIG. 29, it is detected whether the other seats are in progress of playing the game (step S101). When the result of the detection at step S101 is negative (NO of step S101), the process of the other seat checking is finished.

When the other seats are in progress of playing the game (YES of step S101), it is detected whether the scoop-up button 15 is in ready state (step S102).

When the scoop-up button 15 is in ready state (YES of step S102), the other seats are compulsively set in the waiting state with the arm 70 being maintained at the home position (step S109), and the process of the other seat checking is finished.

When the scoop-up button 15 is not in ready state (NO of step S102), it is detected whether the scoop-up button 15 is active (step S103).

When the scoop-up button 15 is active (YES of step S103), setting of the drop button 16 in ready state at the end of the scoop-up operation is awaited (step S104). Subsequently, the arm 70 is shifted to the home position (step S106). And the other seats are compulsively set in the waiting state with the arm 70 being maintained at the home position (step S109), and the process of the other seat checking is finished.

When the scoop-up button 15 is not active (NO of step S103), it is detected whether the drop button 16 is in ready state (step S105).

When the drop button 16 is in ready state (YES of step S105), the arm 70 is shifted to the home position (step S106). And the other seats are compulsively set in the waiting state with the arm 70 being maintained at the home position (step S109), and the process of the other seat checking is finished.

When the drop button 16 is not in ready state (NO of step S105), it is detected whether the drop button 16 is active (step S107). When the drop button 16 is not active (NO of step S107), the other seats are compulsively set in the waiting state with the arm 70 being maintained at the home position (step S109), and the process of the other seat checking is finished.

When the drop button 16 is active (YES of step S107), the end of the game is awaited (step S108), and the other seats are compulsively set in the waiting state with the arm 70 being maintained at the home position (step S109), and the process of the other seat checking is finished.

Referring back to FIG. 27, after the end of the other seat checking (step S10), the other seats are compulsively set in the waiting state until the jackpot processing of the seat of the player concerned is complete (step S11). In the meantime, a credit is not accepted during this process.

Subsequently, the drive mechanism (FIG. 10) of the jackpot tray 40 is controlled so that the jackpot disbursement operation is performed (step S12). Namely, in the jackpot disbursement operation, the jackpot tray 40 is rotated to the position confronting the player concerned who wins the jackpot, and inclined so that the premiums stored on the jackpot tray 40 are pushed out and dropped to the field of the player concerned.

It is desirable that the pusher 30 is stopped in the retracted state, so that the player concerned is allowed to push out as many premiums as possible at the start of operation.

Subsequently, it is detected whether the jackpot disbursement operation is completed (step S13), and the loop is performed until the jackpot disbursement operation ends.

When the jackpot disbursement operation is completed (YES of step S13), the other seats are returned to the original state (step S14).

Subsequently, it is detected whether there is any credit (step S15). When there is a credit (YES of step S15), the control is returned to the detection (step S3) of the scoop-up button 15, and the game is continued.

When there is no credit (NO of step S15), the shutter 18 is closed (step S16) and the game ends.

The jackpot tray 40 is set in an empty state by the completion of the jackpot disbursement operation. Since the accumulation of subsequent premiums becomes slow if there are few players, the desire of the player concerned to win the jackpot fades. For this reason, it is desirable that the arm 70 of the vacant seat is automatically operated so that the jackpot tray 40 is replenished with new premiums. In this case, the shutter 18 of the vacant seat where the vacant seat operation is performed automatically is closed.

In the above-described flowchart of FIG. 27, the processing (steps S7-S14) concerning the jackpot operation is carried out after the step S6 in which the premium is dropped. Alternatively, the processing (steps S7-S14) may be performed in parallel to the processing (steps S3-6) after the end of the step S2 in which the shutter is open, in order to allow a continuous play.

Figure 31:
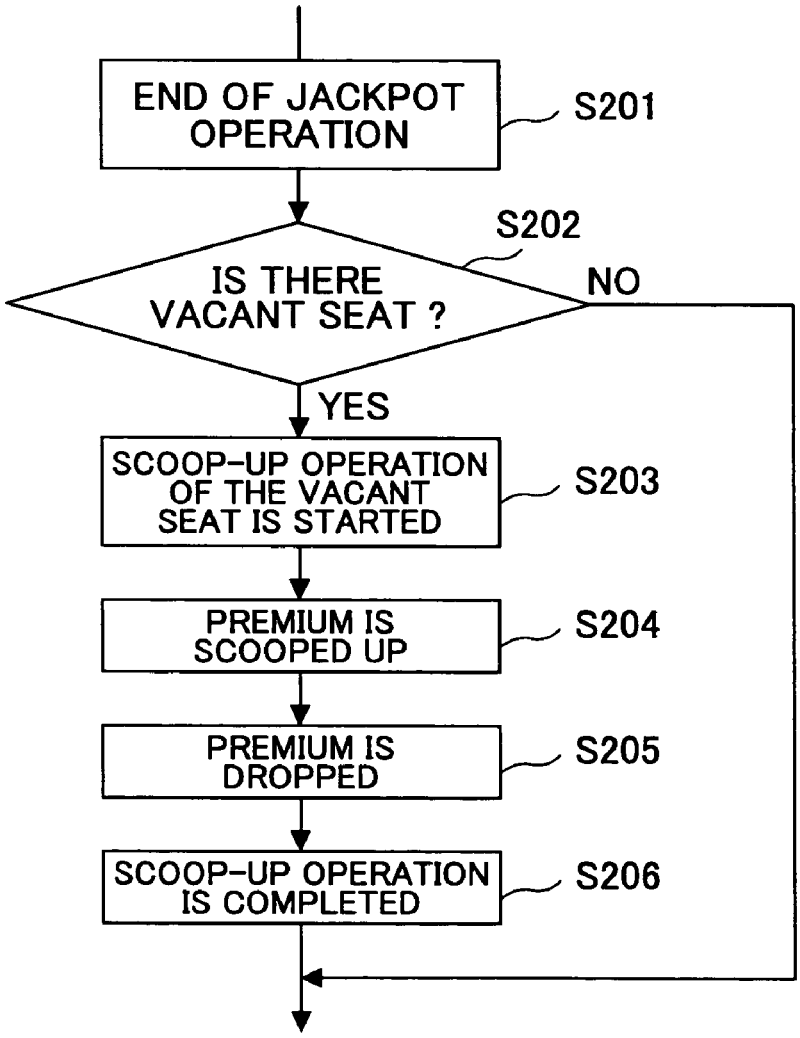
FIG. 31 is a flowchart for explaining the process of the automatic replenishment after the end of the jackpot operation.

FIG. 31 is a flowchart for explaining the process of the automatic replenishment after the end of the jackpot operation.

As shown in FIG. 31, after the end (step S201) of the jackpot operation, it is detected whether there is a vacant seat (step S202). The automatic replenishment is not performed when there is no vacant seat (NO of step S202).

On the other hand, when there is a vacant seat (YES of step S202), the scoop-up operation of the vacant seat is started (step S203). And the premium is scooped up (step S204), the scooped-up premium is dropped (step S205), and the scoop-up operation is completed (step S206).

The scoop-up operation of scooping up and dropping the premium may be performed at two or more times. The scoop-up operation of scooping up and dropping the premium may be continuously performed while any of the seats remains vacant.

Figure 32:
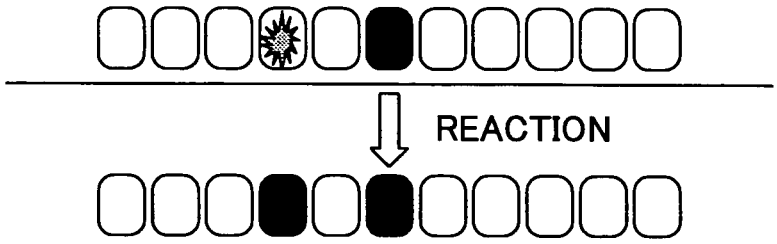
FIG. 32 is a diagram showing the way the jackpot formation position is added.
Figure 33:
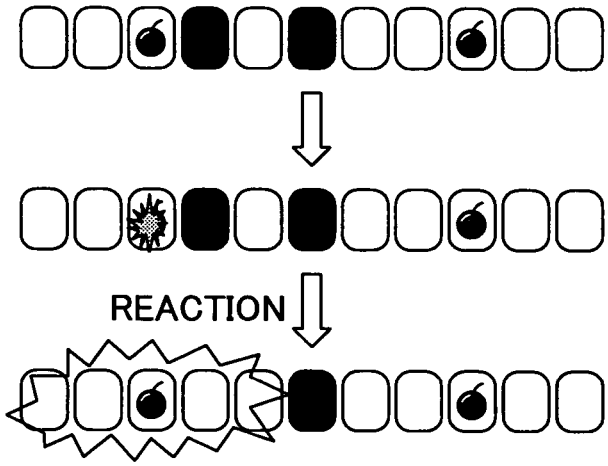
FIG. 33 is a diagram showing the way the added jackpot formation position is cleared.
Figure 34:
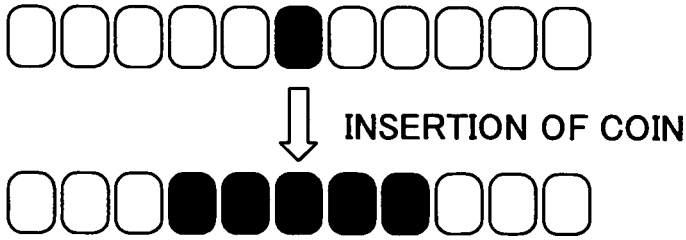
FIG. 34 is a diagram showing the way jackpot formation positions are set up at random.

FIGS. 32-34 show some examples in which the lighting of the lamp ring 80 is devised in order to increase game features further.

In the example of FIG. 32, even when the turned-on lamp of the lamp ring 80 does not stop in the central position of the area for the player concerned which is the given jackpot formation position, a reaction takes place such that the stop position is added as a new jackpot formation position for the next occasion.

In the example of FIG. 33, two or more bomb icons are provided in the area of the lamp ring 80 for the player concerned, and when the lighting stops on a bomb icon, a reaction takes place such that the previously added jackpot formation position is cleared.

In the example of FIG. 34, jackpot formation positions are set up at random in the area of the lamp ring 80 for the player concerned when the game execution is started by insertion of the coin.

The present invention is not limited to the above-described embodiments and variations and modifications may be made without departing from the scope of the present invention. It should not be interpreted that the subject matter of the invention is limited to the above-described embodiments and the accompanying drawings.

The invention claimed is:

1. An article acquisition game apparatus including a storage unit storing a plurality of articles, and an article transferring unit enabling a player to hold the articles in the storage unit and transfer the articles to a predetermined transfer position when the player operates an operation input unit, the article acquisition game apparatus comprising:

a distributing unit provided in a drop route of the articles transferred to the transfer position, the distributing unit dividing the articles into two or more groups;

a first accumulating unit accumulating at least one group of the articles divided by the distributing unit;

an article disbursement unit allowing the player to take out at least one group of the articles other than the articles accumulated by the first accumulating unit;

an operating information generating unit generating operating information based on predetermined conditions; and an ejecting unit ejecting the articles accumulated by the first accumulating unit, to the article disbursement unit, based on the operating information.

2. The article acquisition game apparatus according to claim 1, wherein the distributing unit comprises a distribution board including a flat portion and a downwardly curved lug portion on one side of the flat portion.

3. The article acquisition game apparatus according to claim 1, wherein the operating information generation unit uses, as a trigger to generate the operating information, a detection signal which is outputted by a sensor switch when the sensor switch contacts the articles.

4. The article acquisition game apparatus according to claim 1, further comprising a lamp ring in which lamps are arranged in a ring formation, the lamps being turned on sequentially so that lighting of the lamps occurs around a circumference of the lamp ring, wherein a jackpot formation which causes the ejecting unit to work is detected when a lighting position of the lamp ring is in a predetermined position at the time of generating of the operating information by the operating information generating unit.

5. The article acquisition game apparatus according to claim 1, wherein when a coin is not inserted by the player after operation of the ejecting unit, the article transferring unit is automatically operated so that the first accumulating unit is replenished with additional articles.

6. The article acquisition game apparatus according to claim 1, wherein the first accumulating unit comprises a jackpot tray, and the ejecting unit is adapted for ejecting the articles from the jackpot tray.

7. The article acquisition game apparatus according to claim 1, wherein the first accumulating unit comprises a jackpot tray which is provided with a slope having a loose inclination in a direction in which the articles are taken out.

8. The article acquisition game apparatus according to claim 1, wherein the first accumulating unit comprises a jackpot tray, and the ejecting unit is adapted for rotating the jackpot tray to a position confronting the player, and for inclining the jackpot tray to eject the articles to the article disbursement unit.

9. The article acquisition game apparatus according to claim 8, further comprising a detecting unit detecting whether the jackpot tray is in a predetermined position, when the jackpot tray is housed.

10. The article acquisition game apparatus according to claim 1, wherein the first accumulating unit comprises a jackpot tray, and the ejecting unit is adapted such that rotation of the jackpot tray to a position confronting the player, and inclination of the jackpot tray to eject the articles to the article disbursement unit are performed by either a forward rotation operation or a reverse rotation operation of a motor driving the jackpot tray.

11. The article acquisition game apparatus according to claim 10, wherein one of a forward rotation operation and a reverse rotation operation of the motor driving the jackpot tray is selected by using a one-way clutch which is provided on a drive shaft of the motor.

12. The article acquisition game apparatus according to claim 10, wherein one of a forward rotation operation and a reverse rotation operation of the motor driving the jackpot tray is selected by using a latch mechanism which is provided on a drive shaft of the motor.

13. The article acquisition game apparatus according to claim 1, wherein a normal operation related to article acquisition is suspended during the ejecting of the articles to the article disbursement unit by the ejecting unit.

14. An article acquisition game apparatus including a storage unit storing a plurality of articles, and an article transferring unit enabling a player to hold the articles in the storage unit and transfer the articles to a predetermined transfer position when the player operates an operation input unit, the article acquisition game apparatus comprising:

a distributing unit provided in a drop route of the articles transferred to the transfer position, the distributing unit dividing the articles into two or more groups;

a first accumulating unit accumulating at least one group of the articles divided by the distributing unit;

a second accumulating unit accumulating at least one group of the articles other than the articles accumulated by the first accumulating unit;

an article disbursement unit allowing the player to take out part of the articles accumulated by the second accumulating unit;

a transportation unit transporting the articles accumulated by the second accumulating unit, to the article disbursement unit;

an operating information generation unit generating operating information based on predetermined conditions; and an ejecting unit ejecting the articles accumulated by the first accumulating unit, to the article disbursement unit, based on the operating information.

15. The article acquisition game apparatus according to claim 14, wherein the transportation unit comprises:

a plank-like pusher;

a roller having a center movable along a circular locus; and a guide groove formed in a back surface of the pusher and brought in contact with the roller, the guide groove extending in a direction perpendicular to a direction of a sliding motion of the pusher, wherein a radius of the locus of the roller is variable.

16. An article acquisition game apparatus including a storage unit storing a plurality of articles, and an article transferring unit enabling a player to hold the articles in the storage unit and transfer the articles to a predetermined transfer position when the player operates an operation input unit, the article acquisition game apparatus comprising:

a distributing unit provided in a drop route of the articles transferred to the transfer position, the distributing unit dividing the articles into two or more groups;

a first accumulating unit accumulating at least one group of the articles divided by the distributing unit;

a second accumulating unit accumulating at least one group of the articles other than the articles accumulated by the first accumulating unit;

an article disbursement unit allowing the player to take out part of the articles accumulated by the second accumulating unit;

a transportation unit transporting the articles accumulated by the second accumulating unit, to the article disbursement unit;

an operating information generation unit generating operating information based on predetermined conditions; and an ejecting unit ejecting the articles accumulated by the first accumulating unit, to the second accumulating unit, based on the operating information.

17. An article acquisition game apparatus including a storage unit storing a plurality of articles, and an article transferring unit enabling each of a plurality of players to hold the articles in the storage unit and transfer the articles to a predetermined transfer position when each player operates an operation input unit provided for each player, the article acquisition game apparatus comprising:

a distributing unit provided in a drop route of the articles transferred to the transfer position, the distributing unit dividing the articles into two or more groups;

a first accumulating unit provided in common for the plurality of players and accumulating at least one group of the articles divided by the distributing unit;

a second accumulating unit accumulating at least one group of the articles other than the articles accumulated by the first accumulating unit;

an article disbursement unit provided for each player and allowing the player concerned to take out part of the articles accumulated by the second accumulating unit;

a transportation unit transporting the articles accumulated by the second accumulating unit, to the article disbursement unit;

an operating information generation unit generating operating information based on predetermined conditions; and an ejecting unit ejecting the articles accumulated by the first accumulating unit, to the article disbursement unit, based on the operating information.

18. The article acquisition game apparatus according to claim 17, wherein the transportation unit comprises:

a plurality of plank-like pushers;

a groove cam in which a guide groove is formed;

a rocking crank provided for each of the plurality of plank-like pushers and brought in contact at a first end with the guide groove formed in the groove cam; and a guide groove formed in a back surface of each of the plurality of plank-like pushers and brought in contact with a roller at a second end of the rocking crank, the guide groove extending in a direction perpendicular to a direction of a sliding motion of a corresponding one of the plurality of plank-like pushers, wherein a radius of rotation of the roller is variable.

19. An article acquisition game apparatus including a storage unit storing a plurality of articles, and an article transferring unit enabling each of a plurality of players to hold the articles in the storage unit and transfer the articles to a predetermined transfer position when each player operates an operation input unit provided for each player, the article acquisition game apparatus comprising:

a distributing unit provided in a drop route of the articles transferred to the transfer position, the distributing unit dividing the articles into two or more groups;

a first accumulating unit provided in common for the plurality of players and accumulating at least one group of the articles divided by the distributing unit;

a second accumulating unit accumulating at least one group of the articles other than the articles accumulated by the first accumulating unit;

an article disbursement unit provided for each player and allowing the player concerned to take out part of the articles accumulated by the second accumulating unit;

a transportation unit transporting the articles accumulated by the second accumulating unit, to the article disbursement unit;

an operating information generation unit generating operating information based on predetermined conditions; and an ejecting unit ejecting the articles accumulated by the first accumulating unit, to the second accumulating unit, based on the operating information.

* * * * *